US007637499B2

(12) United States Patent
Kawashima et al.

(10) Patent No.: US 7,637,499 B2
(45) Date of Patent: Dec. 29, 2009

(54) SHEET FEEDING APPARATUS AND RECORDING APPARATUS

(75) Inventors: Hideki Kawashima, Kawasaki (JP); Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 11/671,081

(22) Filed: Feb. 5, 2007

(65) Prior Publication Data

US 2007/0182089 A1 Aug. 9, 2007

(30) Foreign Application Priority Data

Feb. 9, 2006 (JP) ..... 2006-032448

(51) Int. Cl.
*B65H 9/00* (2006.01)

(52) U.S. Cl. ..... 271/240; 271/238; 271/239; 271/248; 271/250

(58) Field of Classification Search ..... 271/13, 271/15, 17, 238, 240, 248–255, 171, 3.02
See application file for complete search history.

(56) References Cited

U.S. PATENT DOCUMENTS

| | | | | |
|---|---|---|---|---|
| 6,608,976 | B2 | 8/2003 | Nishitani et al. | 399/69 |
| 6,618,574 | B2 | 9/2003 | Nishitani | 399/329 |
| 6,671,471 | B2 | 12/2003 | Nakamura et al. | 399/69 |
| 6,731,901 | B2 | 5/2004 | Nishitani et al. | 399/329 |
| 6,741,831 | B2 | 5/2004 | Seto | |
| 6,862,081 | B2 * | 3/2005 | Soya | 355/407 |
| 2001/0026044 | A1 * | 10/2001 | Kawakami et al. | 271/234 |
| 2003/0129008 | A1 | 7/2003 | Seto | |
| 2004/0188929 | A1 * | 9/2004 | Tada et al. | 271/248 |
| 2005/0023744 | A1 * | 2/2005 | Okamoto | 271/113 |
| 2005/0056990 | A1 * | 3/2005 | Milton | 271/248 |
| 2005/0242486 | A1 * | 11/2005 | Lee et al. | 271/121 |

FOREIGN PATENT DOCUMENTS

| | | |
|---|---|---|
| EP | 0 466 172 A2 | 1/1992 |
| EP | 1 580 013 A2 | 9/2005 |
| JP | 4-072252 | 3/1992 |
| JP | 04072252 A * | 3/1992 |
| JP | 4-235847 | 8/1992 |

OTHER PUBLICATIONS

Official Letter/Search Report issued by the Korean Patent Office on Feb. 28, 2008, in Korean Application No. 10-2007-0013551.
Official Letter/Search Report (English Translation), dated Jun. 12, 2009, issued by the State Intellectual Property Office of the People's Republic of China, in Chinese Patent Application No. 2007100028825.

* cited by examiner

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

A sheet feeding apparatus to which a cassette accommodating a sheet is detachably mountable includes supplying means for supplying the sheet from the cassette; a reference member having a reference surface for regulating a position of a lateral edge of the sheet being fed in a predetermined feeding direction by the supplying means; feeding means for feeding the sheet in a direction inclined relative to the feeding direction toward the reference surface to abut the lateral edge of the sheet to the reference surface; and moving means for selectively moving the reference member in response to mounting of the cassette such that reference member is placed at a position corresponding to a width of the sheet accommodated in the cassette.

10 Claims, 17 Drawing Sheets

SHEET FEEDING APPARATUS AND RECORDING APPARATUS

FIELD OF THE INVENTION

The present invention relates to a sheet feeding apparatus for feeding a recording sheet fed from a cassette in an image recording apparatus such as a printer, a copying machine, a facsimile machine, and a recording apparatus using the sheet feeding apparatus.

RELATED ART

In a recording apparatus having a function of a printer, a copying machine, a facsimile machine or the like, an image (including letters, sign or the like) is recorded on the recording sheet on the basis of image information by a recording head. The recording material (recording sheet) may be paper, textile, plastic resin material sheet or OHP sheet or the like. The recording system of such a recording apparatus is either one of a serial type and a line type. In a serial type, a main-scanning operation moving the recording head along the recording material and a sub-scan operation feeding the recording material are alternately repeated. In a line type, on the other hand, a long recording head extending in a widthwise direction of the recording material is used wherein the recording is effected at once on a line, and the recording material fed, thus the scanning operation is effected only in one direction.

The recording apparatus is provided with a sheet feeding apparatus for picking the recording sheet one by one up from the cassette or the like and for feeding the recording sheet to the image forming station. In such a sheet feeding apparatus, the recording sheet may be fed obliquely due to insufficient sheet feeding accuracy or the like. Such an oblique feeding may be a cause of sheet jamming and/or deterioration of the recorded image quality. Japanese Laid-open Patent Application Hei and Japanese Laid-open Patent Application Hei, for example, disclose an inclination correcting mechanism for rectifying the feeding operation. FIG. 20 is a substantial top plan view of an example of conventional inclination correcting mechanisms. In FIG. 17, designated by 502 is a feeding roller for feeding the recording sheet in the direction indicated by an arrow T. Designated by 503 is an inclination roller disposed inclined relative to the feeding direction T and opposed to the feeding roller 502.

The recording sheet 504 is nipped between the inclination roller 503 and the feeding roller 502 and is fed by rotation of the feeding roller. Designated by 501 is a reference member provided at a side of a feeding surface. Reference member 501 is provided with a reference surface 501*a* which is parallel with the feeding direction T and which is perpendicular to the feeding surface. The reference surface is effective to position the recording sheet 504 in the direction perpendicular to the feeding direction and functions as a guide for feeding the recording sheet in the feeding direction T. The reference member 501 comprises a wall member or projection member so that lateral edge of the recording sheet assuredly abuts the reference surface 501*a*.

Referring to FIG. 20, the description will be made as to inclination correction of recording sheet feeding using the reference member 501. When the recording sheet 504 is fed obliquely, the leading end of the recording sheet is inclined in the counterclockwise direction in the Figure by an inclined roller 503, and the lateral edge of the recording sheet is brought into contact to the reference surface 501*a*. By this, the movement of the recording sheet is corrected such that lateral edge thereof moves along the reference surface while the lateral edge is in contact with the reference surface. Thus, the inclination of the recording sheet 504 is corrected, and the recording sheet 504 is correctly positioned with respect to the direction parallel to the feeding direction T of the recording sheet on the feeding surface. The reference surface 501*a* is also called "contact or abutment surface" since the recording sheet is contacted or abutted to it. Such an inclination correction method can be implemented with a relatively simple structure.

However, with such an inclination correcting mechanism, when the recording sheets having different widths, it is impossible to feed such sheets with the center thereof aligned with a reference line, although one lateral ends of the sheets may be aligned with a reference line. FIG. 21 is a schematic top plan view of such a state. In FIG. 21, the oblique feeding of the recording sheet 6 is by abutting to the reference member 601. In the inclination correcting mechanism of FIG. 21, the fixed reference member 601 functions to position the sheets with respect to the direction perpendicular to the feeding direction. Therefore, the inclination correction for the recording sheets is based on the abutment surface 601*a* irrespective of the widths of the sheets.

For this reason, the recording sheet having a width smaller than the maximum width is laterally shifted (off-set) toward the reference member 601 as compared with the recording sheet having the maximum width.

Here, the advantages of center line alignment of feeding will be described. In most cases of sheet feeding apparatuses, the parts such as rollers on the feeding surface are disposed symmetrically with respect to the center line of the feeding surface. In the case that recording sheet is fed the lateral edge alignment, the position or the width of the nip varies depending on the widths of the sheets. Therefore, the feeding force distribution with respect to the widthwise direction is not symmetrical with the result of tendency of unbalanced feeding force distribution.

When the center line of the feeding surface and the center line of the recording sheet are aligned with each other, the feeding force distribution is symmetrical, so that sheet can be fed stably with uniform feeding force distribution.

FIG. 22 is a substantial top plan view of a conventional example with which the inclination correction is possible with the center line alignment. As will be understood from FIG. 22, there are provided two reference members 701, 702 to effect the inclination correction with the center line alignment. With the use of the reference member having two reference surfaces 701*a*, 702*a*, the inclination correction is possible for both of the large width recording sheet 7*a* and the small width recording sheet 7*b*. The lateral edges of the recording sheets are abutted to the corresponding one of the reference surfaces. However, with such a method, when the inclination correction is carried out for a large width recording sheet by the reference member 701, the reference member 702 for the small width recording sheet interferes with the recording sheet.

Japanese Laid-open Patent Application Hei 4-72252 and Japanese Laid-open Patent Application Hei 4-235847 disclose an inclination correction mechanism which uses two reference members and in which one of the reference member are selectively movable.

However, the conventional inclination correcting mechanisms as disclosed in the prior art requires a complicated mechanism for moving the reference member from the contact position where the recording sheet abuts it to the contactable position where the recording sheet does not abut it.

This makes assembling of the sheet feeding apparatus difficult and makes the reliability of the feeding performance poor.

SUMMARY OF THE INVENTION

It is a principal object of the present invention to provide a sheet feeding apparatus having an inclination correcting mechanism which is simple in the structure and which is good in assembling property, the inclination correcting mechanism being capable of feeding the sheets with the center line alignment and with inclination correction for recording sheets widths.

According to an aspect of the present invention, there is provided a sheet feeding apparatus to which a cassette accommodating a sheet is detachably mountable, said sheet feeding device comprising supplying means for supplying the sheet from said cassette; a reference member having a reference surface for regulating a position of a lateral edge of the sheet being fed in a predetermined feeding direction by said supplying means; feeding means for feeding the sheet in a direction inclined relative to the feeding direction toward the reference surface to abut the lateral edge of the sheet to the reference surface; and moving means for selectively moving said reference member in response to mounting of said cassette such that reference member is placed at a position corresponding to a width of the sheet accommodated in said cassette.

According to another aspect of the present invention, there is provided a A sheet feeding apparatus to which a cassette accommodating a sheet is detachably mountable, said sheet feeding device comprising supplying means for supplying the sheet from said cassette; a reference member having a reference surface for regulating a position of a lateral edge of the sheet being fed in a predetermined feeding direction by said supplying means; feeding means for feeding the sheet such that lateral edge of the sheet abuts the reference surface; and moving means for selectively moving said reference member in response to mounting of said cassette.

According to the present invention, there is provided a sheet feeding apparatus having an inclination correcting mechanism which is simple in the structure and which is good in assembling property, the inclination correcting mechanism being capable of feeding the sheets with the center line alignment and with inclination correction for recording sheets widths.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
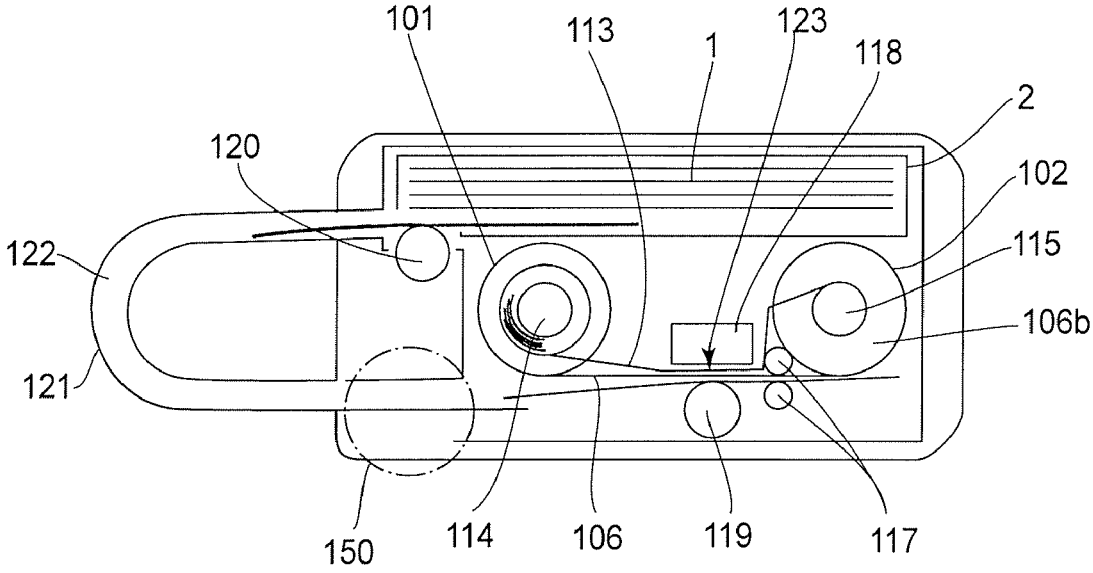
FIG. 1 is a longitudinal sectional view of a recording apparatus which is suitably used with a sheet feeding apparatus according to the present invention.

Hereinafter, the preferred embodiments of the present invention will be concretely described with reference to the appended drawings. Incidentally, if an item in a given drawing is the same in reference symbol in another item in the given drawing or another drawing, the two items are identical or correspond to each other. FIG. 1 is a vertical sectional view of a preferable example of a recording apparatus, to which a sheet feeding apparatus, that is, a sheet conveying apparatus in accordance with the present invention is applicable. It shows a recording apparatus of the thermal transfer type, which records an image by transferring the ink on an ink ribbon onto a sheet of recording medium with the use of a thermal head. Referring to FIG. 1, a cassette 2 in which recording sheets 1 are stored is removably mountable in the main assembly of a recording apparatus 100. Located in the space below the cassette 2 are an ink ribbon chamber 101, from which an ink ribbon 113 is unwound, and an ink ribbon chamber 102, into which the ink ribbon 113 is wound. As a ribbon winding shaft 115 is rotationally driven, the ribbon 113 on a ribbon shaft 114 in the ink ribbon chamber 101 is wound out from the ink ribbon chamber 101 and is wound up onto the shaft 115 in the ink ribbon chamber 102.

The image forming operation carried out by this image forming apparatus is as follows: A single sheet of recording medium is fed into a U-turn sheet conveyance passage 122 provided with a sheet feeding roller 120 as a sheet feeding means, while being separated from the rest of sheets in the cassette 2, and is conveyed through the U-turn passage 122. Then, the recording sheet 1 is conveyed to an image forming portion 123 which is between a recording head 118 (thermal head) and a platen roller 119. A sheet conveying apparatus 150 in accordance with the present invention is between the U-turn sheet conveyance passage 122 and image forming portion 123 in terms of the recording sheet conveyance direction. The recording sheet 1 is conveyed, together with the ribbon 113, through the image forming portion 123, while remaining pinched between the recording head 118 and platen roller 119, by a pair of conveyance rollers 117. While the recording sheet 1 and ink ribbon 113 are conveyed through the image forming portion 123 in the state described above, an image is formed by thermally transferring (melting and transferring) the ink coated on the ink ribbon 113, onto the recording sheet 1 by the heating member with which the recording head 118 is provided. When forming a full-color image, a ribbon for recording in full-color is used. A full-color recording ribbon has multiple sections which repeat in terms of the lengthwise direction of the ribbon, and each section has multiple subsections coated with inks different in color, for example, yellow, magenta, cyan, etc., one for one. Thus, when forming a multicolor or full-color image, the recording sheet 1 is conveyed through the image forming portion 123, in a reciprocating manner, by the number of times equal to the number of colors in which the image is to be formed, so that the inks different in color are transferred in layers onto the recording sheet 1.

Figure 2:
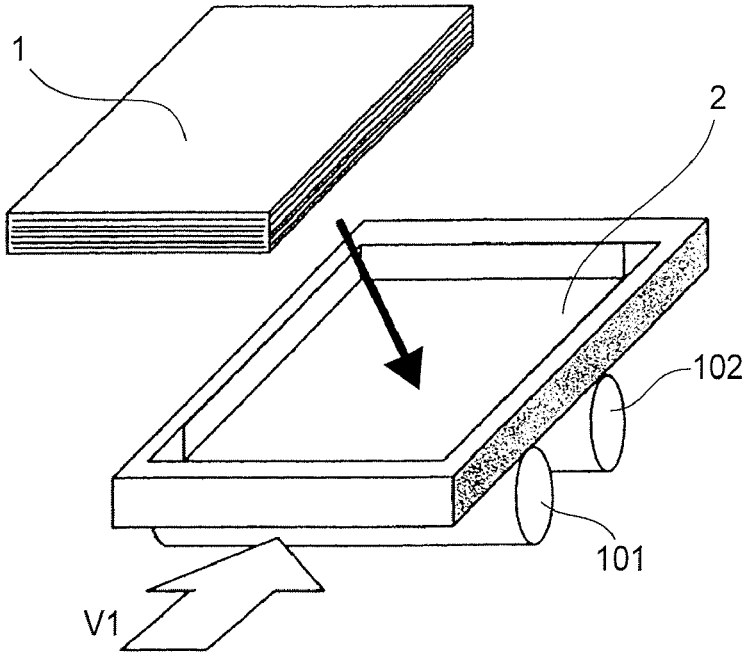
FIG. 2 is a perspective view of a cassette for accommodating recording sheets.
Figure 3:
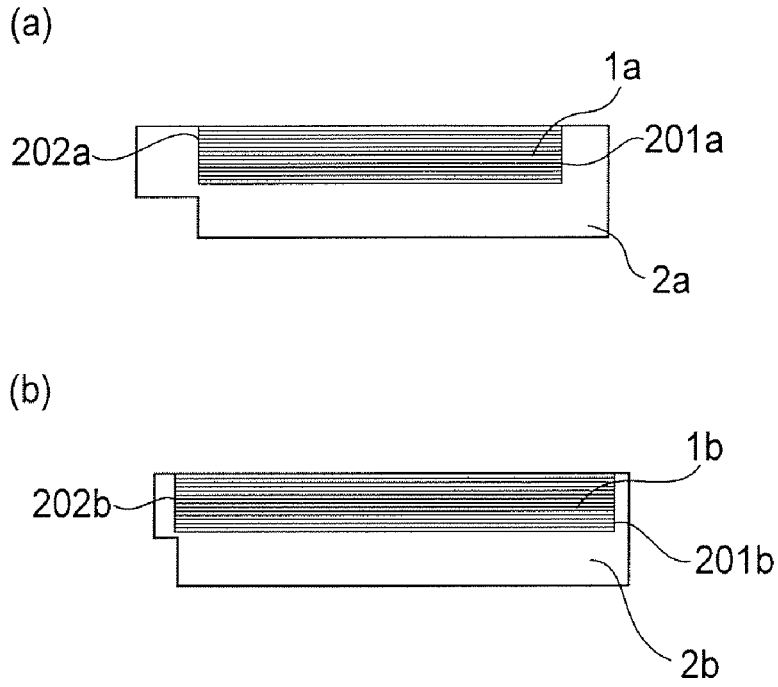
FIG. 3 is a sectional front view of the cassette of FIG. 2 as seen in the direction of arrow V1 in FIG. 1, wherein (a) illustrates a cassette accommodating the recording sheets having a first width (small), and (b) illustrates a cassette accommodating the recording sheets having second width (large).
Figure 4:
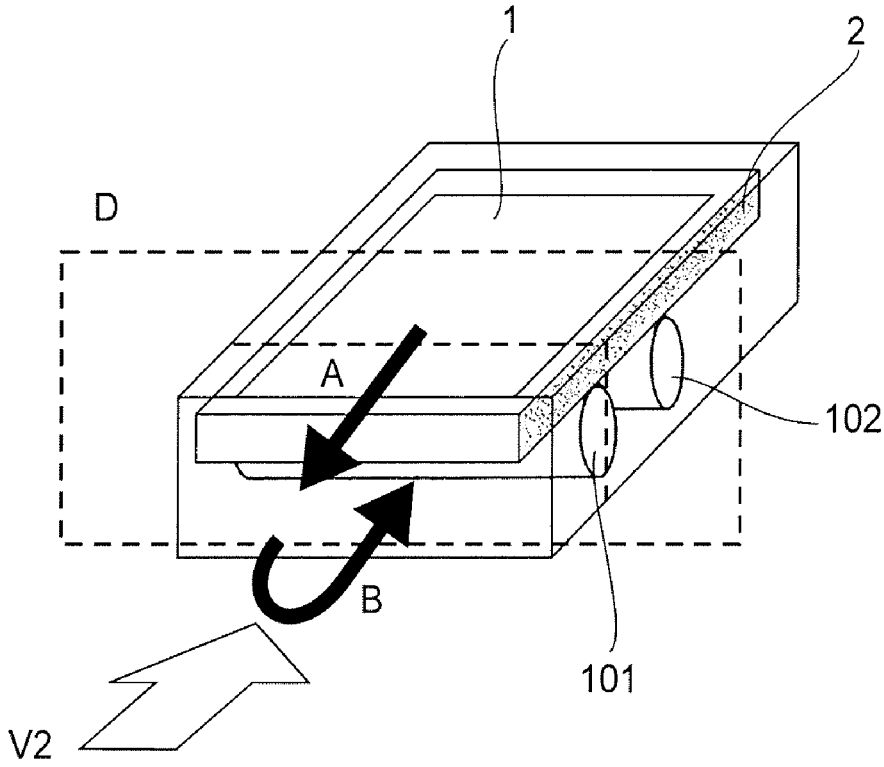
FIG. 4 is a schematic perspective view showing a direction in which the recording sheet is picked up and fed from a cassette mounted to the recording apparatus.

FIG. 2 is a perspective view of the cassette 2 in which one or more of the recording sheets 1 are stored. FIG. 3 is a sectional view of the cassette 2 shown in FIG. 2, at a plane parallel to the front panel of the image forming apparatus, as seen from the direction indicated by an arrow mark V1 in FIG. 2, FIGS. 3(*a*) showing a cassette for holding one or more recording sheets of a first width, that is, narrower recording sheets, and FIG. 3(*b*) showing a cassette for holding one or more recording sheets of a second width, that is, wider recording sheets. FIG. 4 is a schematic, phantom, and perspective view of the cassette 2 in the recording apparatus 100, showing the direction in which the recording sheet 1 is fed into the main assembly of the recording apparatus 100. Referring to FIG. 2, multiple recording sheets 1 are stacked into the cassette 2. This embodiment of the present invention will be described with reference to a case in which two kinds of recording sheets in terms of width, more specifically, recording sheets 1*a* and 1*b*, which are different in width, are used. The recording sheet 1*a*, or the narrower sheet, is stored in the cassette 2*a*, whereas the recording sheet 1*b*, or the wider sheet, is stored in the cassette 2*b*.

Shown in FIG. 3 are the cassettes 2*a* and 2*b*, which are different in the width of the recording sheet stored therein. As will be evident from FIG. 3, the two cassettes 2*a* and 2*b* are differentiated in shape according to the width of the recording sheet 1 therein.

The first cassette 2*a* shown in FIG. 3(*a*) is the cassette which stores the recording sheets 1*a*, or the sheets with the first width. Designated by reference characters 201*a* and 202*a* are regulating portions, which are for regulating the positioning of the lateral edges of the recording sheet 1*a*, one for one. The second cassette 2*b* shown in FIG. 3(*b*) is the cassette which stores the recording sheets 1*b*, or the sheets with the second width which is greater than the first width. Designated by reference characters 201*b* and 202*b* are regulating portions, which are for regulating the positions of the lateral edges of the recording sheet 1*b*, one for one.

Referring to FIG. 4, it is in the direction indicated by an arrow mark A that the recording sheet 1 is fed into the main assembly of the recording apparatus 100 from the cassette 2 in the recording apparatus 100, and is conveyed to the image forming portion 123, by the feeding-and-conveying roller 120. After being sent out of the cassette 2, the recording sheet 1 is made to U-turn in the direction indicated by an arrow mark B following the U-turn conveyance passage 122. Then, the recording sheet 1 is conveyed to the image forming portion 123 through the sheet conveying apparatus 150, which is located on the sheet conveyance surface 5 (FIG. 5) which is located in the area below the cassette 2.

Figure 5:
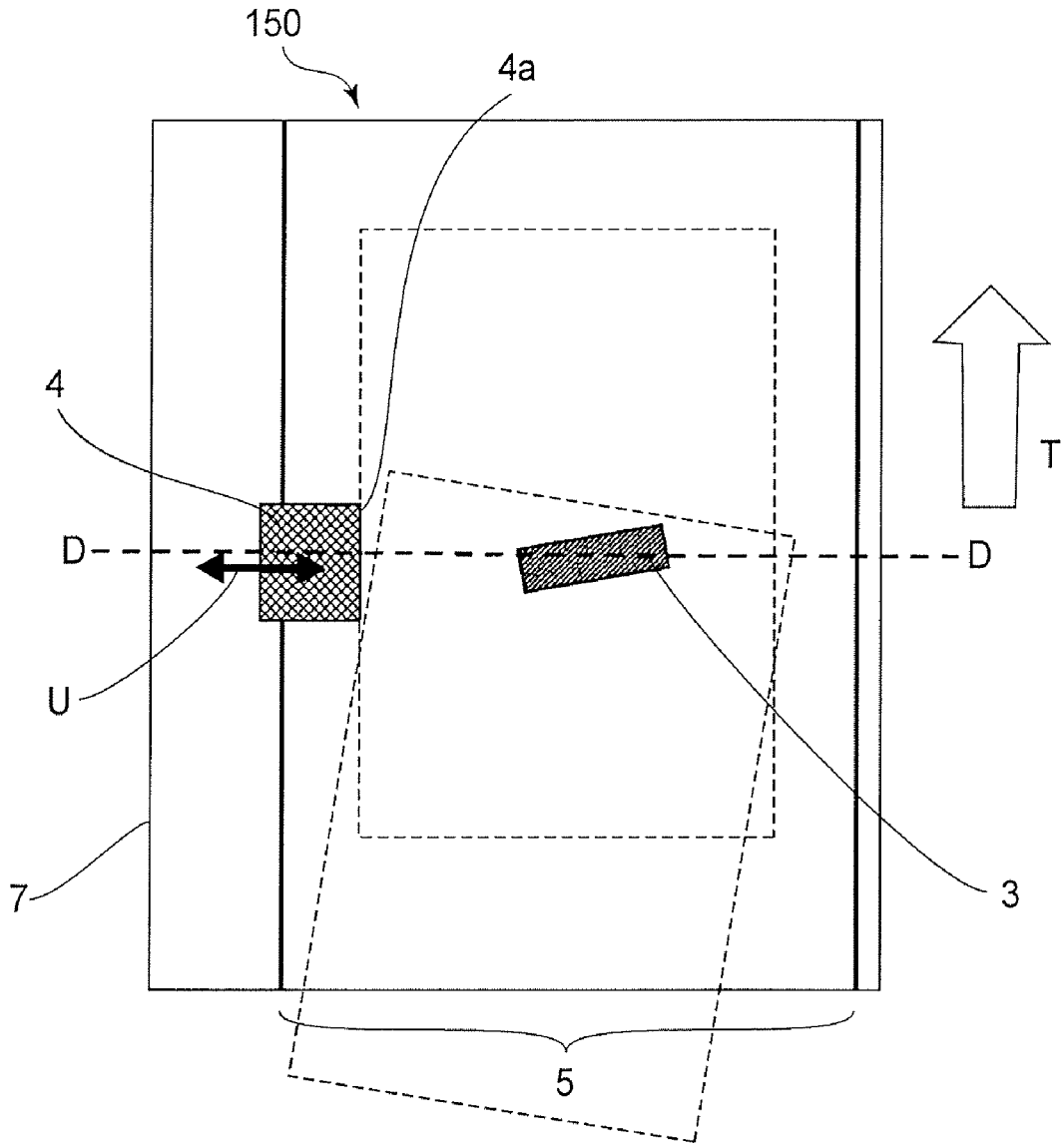
FIG. 5 is a schematic top plan view of the sheet feeding apparatus according to the first embodiment of the present invention.
Figure 6:
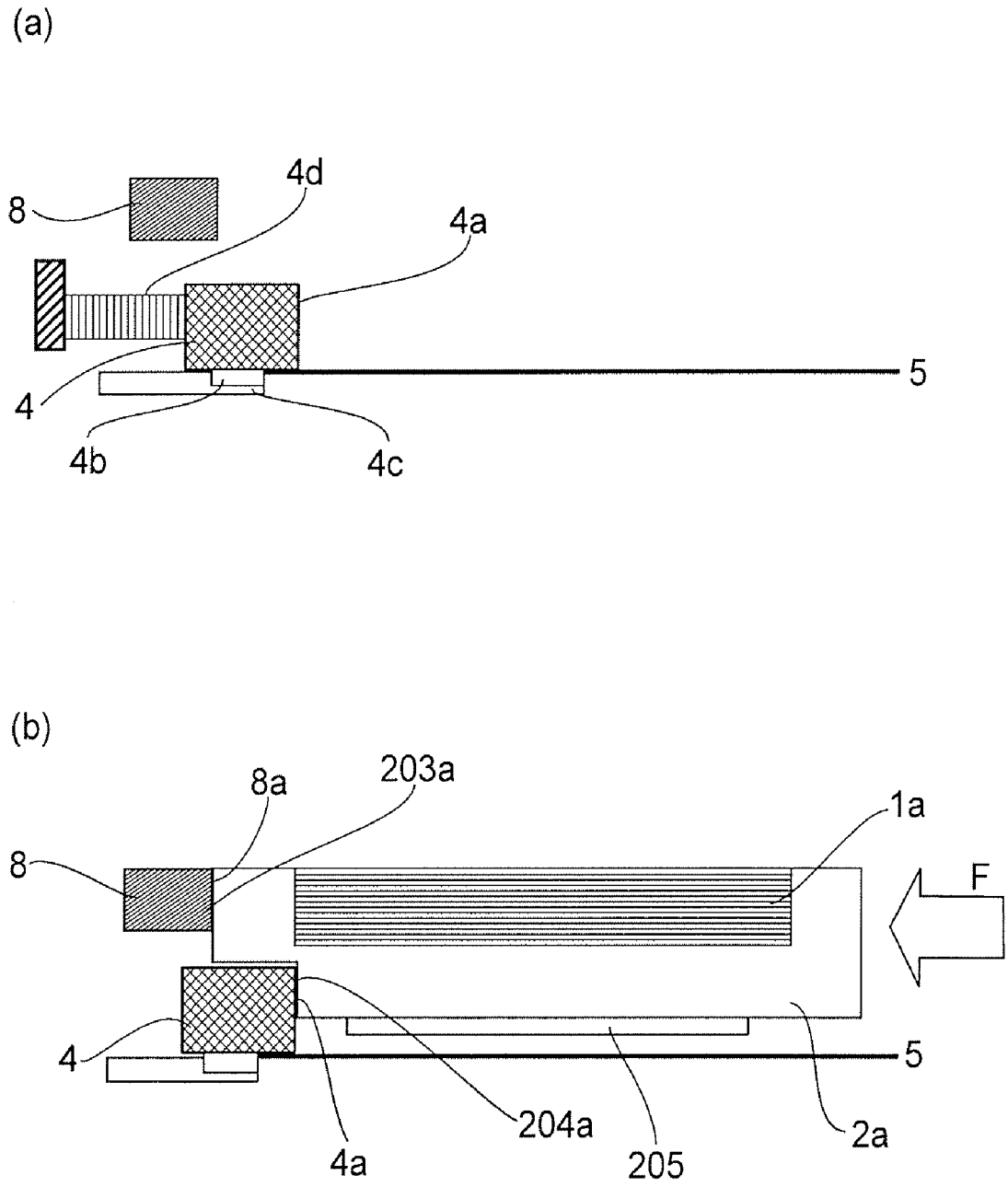
FIG. 6 is a sectional view taken along a line D-D in FIG. 5, wherein (a) shows a state in which the cassette is not mounted, and (b) shows a state in which the cassette accommodating the recording sheets having the first width is mounted.
Figure 7:
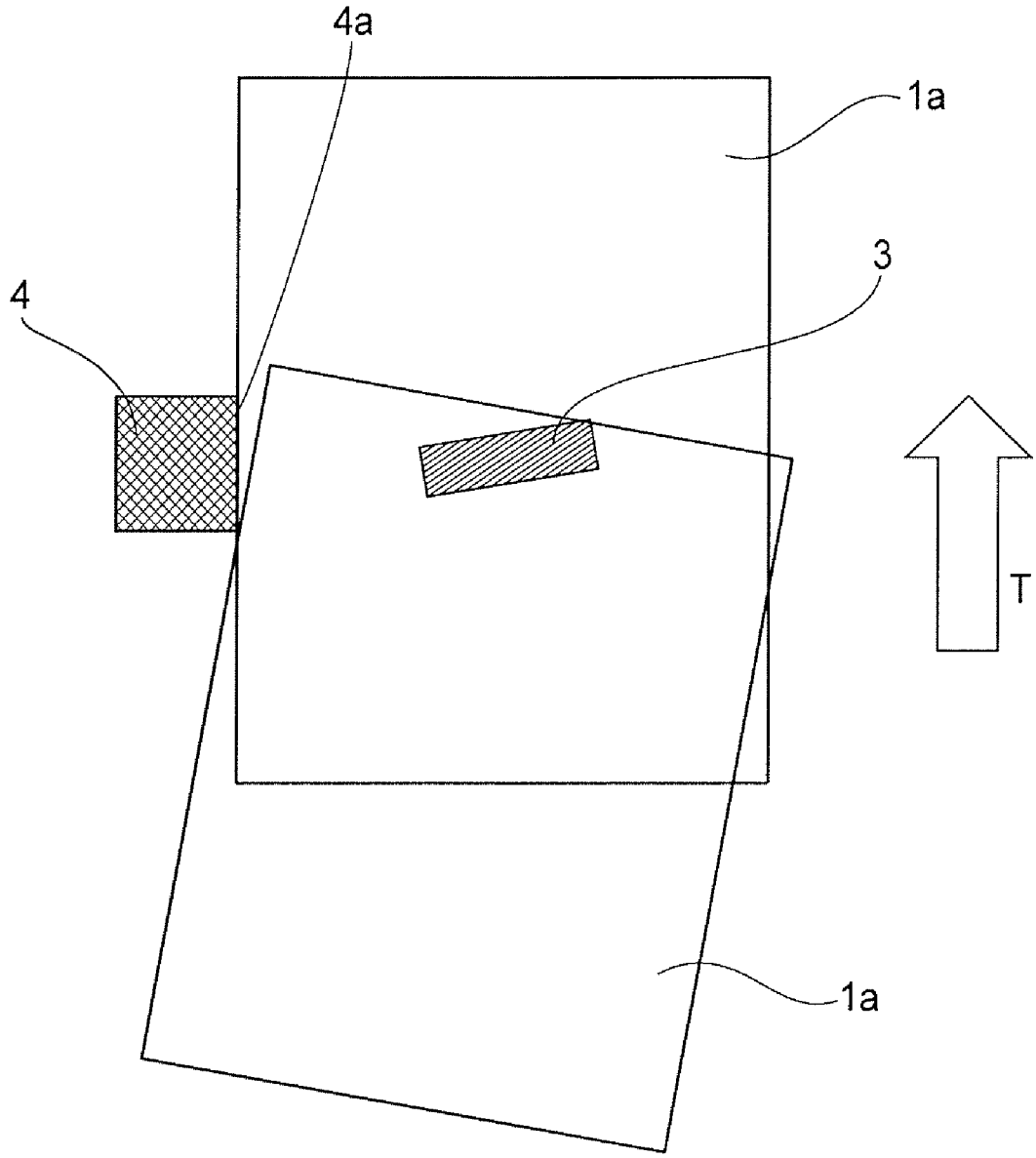
FIG. 7 is a schematic top plan view showing a state when the inclination of the recording sheet having the first width is being corrected in the sheet feeding apparatus according to the first embodiment of the present invention.
Figure 8:
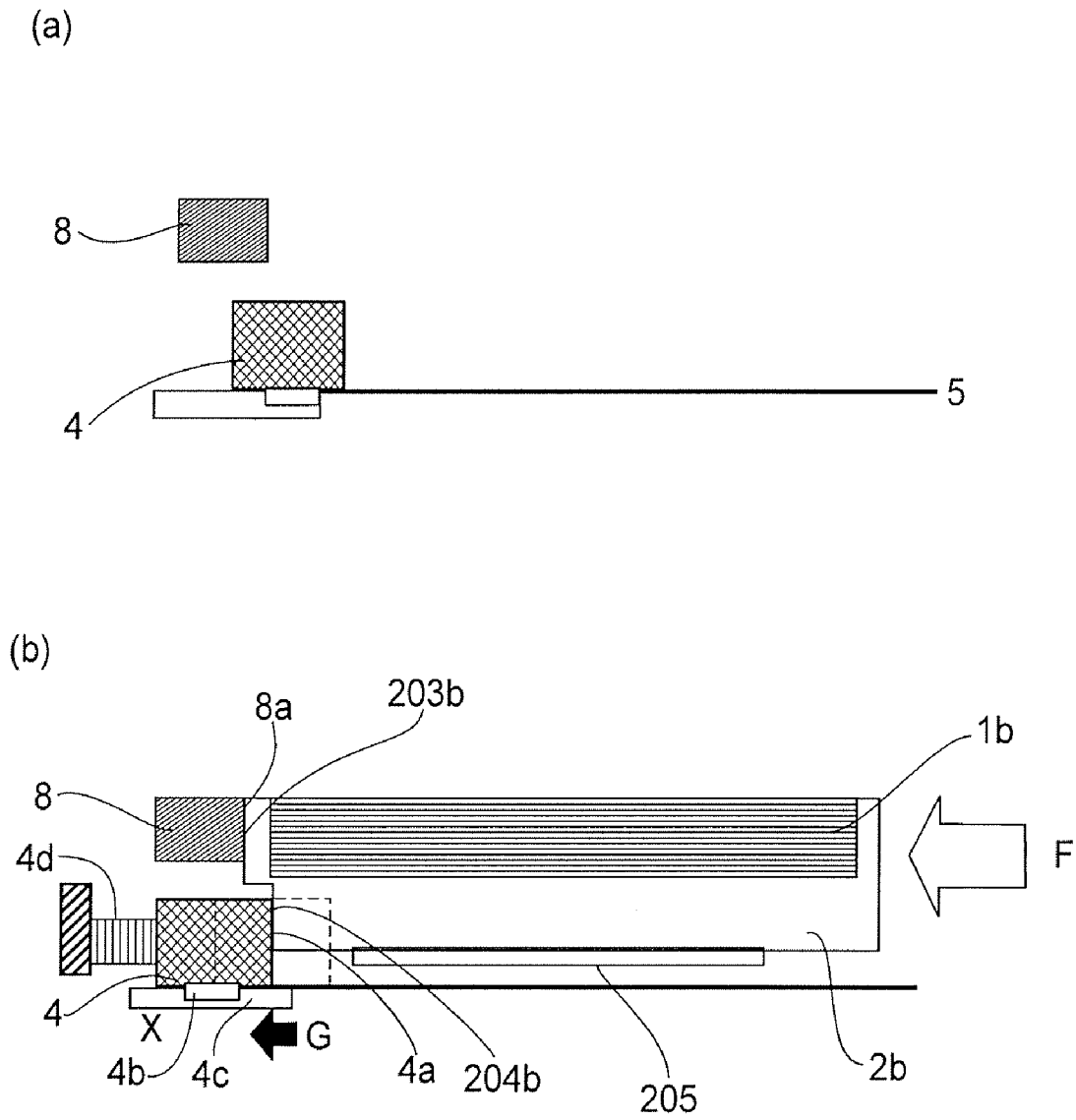
FIG. 8 is a sectional view taken along a line D-D in FIG. 5, wherein (a) shows a state in which the cassette is not mounted, and (b) shows a state in which the cassette accommodating the recording sheets having the second width is mounted.
Figure 9:
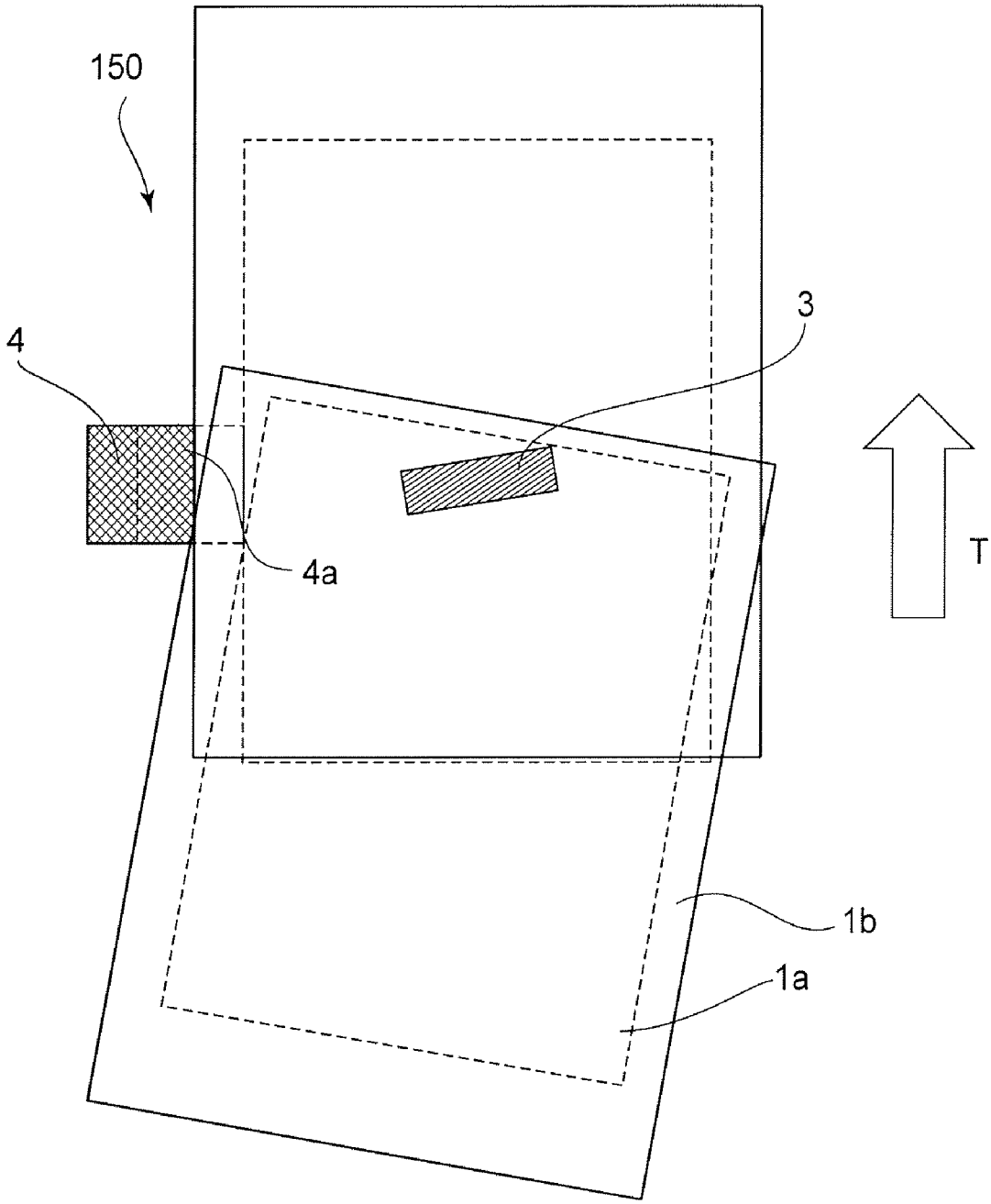
FIG. 9 is a schematic top plan view showing a state in which the inclination of the recording sheet having the second width is being corrected in the sheet feeding apparatus according to the first embodiment of the present invention.

FIG. 5 is a schematic plan view of the sheet conveying apparatus 150 in the first embodiment of the present invention. FIG. 6(*a*) is a sectional view of the sheet conveying apparatus 150, at a line D-D in FIG. 5, above which the cassette 2 is not present, and FIG. 6(*b*) is a sectional view of the sheet conveying apparatus, at the line D-D in FIG. 5, above which the cassette 2*a* containing the recording sheets 1*a*, or the cassette containing the recording sheets with the smaller width, are present. FIG. 7 is a schematic plan view of the sheet conveying apparatus 150 in the first embodiment of the present invention, which is in the process of straightening the recording sheet 1*a*, or the positioned recording sheet with the narrower width, which is being obliquely conveyed. FIG. 8(*a*) is a sectional view of the sheet conveying apparatus 150, at the line D-D in FIG. 5, above which the cassette 2 is not present, and FIG. 8(*b*) is a sectional view of the sheet conveying apparatus 150, at the line D-D in FIG. 5, above which the cassette 2*b* containing the recording sheets 1*b*, or the recording sheets with the larger width, are present. FIG. 9 is a schematic plan view of the sheet conveying apparatus 150 in the first embodiment of the present invention, which is in the process of straightening the recording sheet 1*b*, or the recording sheet with the larger width, which is being obliquely conveyed.

Referring to FIG. 5, located on the center area of the sheet conveyance surface 5 is a sheet feeding or conveyance roller 3 (inclined or slant roller), as a sheet conveying means, which is inclined or slanted so that it generates sheet conveyance force in a direction inclined relative to the normal sheet conveyance direction T. Located on one of the lateral areas of sheet conveyance surface 5 is a positional reference member 4, which has a reference surface 4*a* with which the lateral edge of a recording sheet is placed in contact in order to regulate the position of the recording sheet.

Referring to FIG. 6, the reference member 4 is attached to the frame 7 of the recording apparatus so that it is movable in the direction (for example, direction indicated by arrow mark U) perpendicular to the normal sheet conveyance direction T. Designated by a reference character 4*c* is a guide for guiding the reference member 4 when the reference member 4 is moved in the direction of the arrow mark U. Designated by a reference character 4*b* is a protrusion which is fitted in a guide 4*c*. The reference member 4 is kept pressured inward of the sheet conveyance surface 5, in terms of the width direction of the sheet conveyance surface 5, by a spring 4*d*, and is held in the home position (initial position), shown in FIGS. 5-7, by a stopper.

Next, referring to FIGS. 6-9, the operation of the sheet conveying apparatus 150 in the first embodiment of the present invention will be described. The cassette 2 is inserted into the recording apparatus 150 from the direction indicated by an arrow mark F, and is moved into its preset operational position in the recording apparatus 150. Designated by a reference number 205 is a cassette guide for guiding the cassette 2 into the abovementioned preset operational position in the recording apparatus. Located in the area above the left end portion of the sheet conveyance surface 5 is a cassette positioning member 8 (which hereafter will be referred to simply as positioning member 8) for regulating the position of the cassette 2 when the cassette 2 is mounted into the recording apparatus. First, the case in which the cassette 2*a*, or the cassette in which recording sheets 1*a*, or the recording sheets with the smaller width, is mounted into the recording apparatus, will be described. When the sheet conveying apparatus is in the state shown in FIG. 6(*a*), that is, before the cassette 2*a* is mounted into the recording apparatus, the reference member 4 is held in the home position (initial position). As the cassette 2*a* is moved into the abovementioned operational position in the recording apparatus, the cassette positioning surface 203*a* of the cassette 2*a* comes into contact with, and remains in contact, with the cassette positioning surface 8*a* of the positioning member 8, and therefore, the cassette 2*a* is correctly placed, and kept, in the operational position. That is, when the cassette 2*a*, or the cassette in which the recording sheets 1*a* of the smaller width are stored, is mounted, the reference member 4 is not pressed by the cassette 2*a*; the reference member 4 remains held in its home position, as shown in FIG. 6(*b*). Therefore, as the recording sheet 1*a*, which is being obliquely conveyed, reaches the sheet conveying apparatus, it is straightened by the sheet conveying apparatus, with the reference member 4 remaining held in its home position, as shown in FIG. 7 (correction of oblique feeding).

More specifically, referring to FIG. 7, as the recording sheet 1*a*, or the sheet with the smaller width, which is being conveyed askew, reaches the sheet conveying apparatus 150, it begins to be conveyed in the direction which is slightly deviant leftward from the normal sheet conveyance direction T in the drawing, by the sheet conveyance roller 3, which is positioned at the abovementioned angle, and one of the lateral edges of the recording sheet 1*a* is placed in contact with the reference surface 4*a* of the reference member 4. Thus, the recording sheet 1*a* is conveyed through the sheet conveying apparatus 150 while remaining in contact with the reference surface 4*a* which is in its home position. As a result, not only is the recording sheet 1*a*, which has obliquely arrived at the sheet conveying apparatus 150, is straightened by the reference surface 4*a*, but also, it is correctly position in terms of its width direction by the reference surface 4*a*.

Next, the case in which the cassette 2*b*, or the cassette in which the recording sheets 1*b*, or the recording sheets with the second width, which is larger than the first width, are stored, are mounted, will be described. When the sheet conveying apparatus is in the state shown in FIG. 8(*a*), that is, before the cassette 2*b* is mounted into the recording apparatus, the reference member 4 remains held in the home position. As the cassette 2*b* is inserted into the recording apparatus from the direction of the arrow mark F, and is moved into the operational position in the recording apparatus, the cassette positioning surface 203*b* of the cassette 2*b* comes into contact with, and remains in contact, with the cassette positioning surface 8*a* of the positioning member 8, and therefore, the cassette 2*b* is correctly placed, and kept, in the operational position, as shown in FIG. 8(*a*). That is, when the cassette 2*b*, or the cassette in which the recording sheets of the second width are stored, is mounted, the reference surface 4*a* of the reference member 4 comes into contact with the reference member pressing surface 204*b* (reference member moving means) of the cassette 2*b*, and is pressed leftward of the drawing by the cassette 2*b*. As a result, the reference member 4 is moved leftward of the drawing against the pressure application spring 4*d*; in this embodiment, the reference member 4 is moved from its home position in the direction indicated by an arrow mark G, into a position X, which is closer to the lateral edge of the sheet conveyance surface 5 than the home position of the reference member 4. Then, as the recording sheet 1*b*, which is being obliquely conveyed, reaches the sheet conveying apparatus 150, it begins to be conveyed in the direction which is slightly deviant leftward from the normal sheet conveyance direction T in the drawing, by the conveyance roller 3, which is slanted, and one of the lateral edges of the recording sheet 1*b* is placed in contact with the reference surface 4*a* of the reference member 4 which is in the position X. Thus, the recording sheet 1*b* is conveyed through the sheet conveying apparatus 150 while remaining in contact with the reference surface 4*a* which is in the position X. As a result, not only is the recording sheet 1*b*, which has obliquely arrived at the sheet conveying apparatus 150, is straightened (correction of oblique feeding), but also, it is correctly position in terms of its width direction, as shown in FIG. 9.

If the abovementioned recording sheet 1*a* or recording sheet 1*b*, which are different in width, is obliquely conveyed, the recording sheet 1*a*, or the recording sheet with the smaller width, is straightened by the reference surface 4*a* of the reference member 4 while the reference member 4 is in its home position, whereas the recording sheet 1*b*, or the recording sheet with the larger width, is straightened by the reference surface 4*a* of the reference member 4 in the position X, into which the reference member 4 was moved by the cassette 2*b*. Further, the sheet conveying apparatus is structured so that the path of the center of the recording sheet 1*a*, or the recording sheet with the smaller width coincides with the path of the center of the recording sheet 1*b*, or the recording sheet with the larger width (so that centers of two kinds of sheets in terms of width direction coincide). This structural arrangement can be realized by setting the distance by which the reference member 4 is to be moved, according to the width of the recording sheet which is being conveyed. With the reference member 4 placed in the position X into which the reference member 4 is moved by the distance which corresponds to the width of the recording sheet which is being conveyed, not only is the recording medium, which is being obliquely conveyed, straightened, but also, it is positioned so that the path of its center roughly aligns with the path of the centers of the other recording sheets, when two kinds of recording sheets in terms of width are conveyed through the sheet conveying apparatus 150. Incidentally, the sheet conveying apparatus 150 is structured so that when the recording sheet 1 in the sheet conveying apparatus 150 is correct in its attitude and position, its center roughly aligns with the center line of the sheet conveyance surface 5, in terms of the width direction of the recording sheet.

More specifically, in the first embodiment described above, as the recording sheet 1 is conveyed to the sheet conveying apparatus 150, the recording sheet 1 is conveyed by the conveyance roller 3, which is slanted, in the direction which is deviant toward the reference member 4, regardless of whether or not the recording sheet 1 is obliquely positioned. As the recording sheet 1 is conveyed in the deviant direction, one of its lateral edges comes into contact with the reference surface 4*a* of the reference member 4 which is movable in the width direction of the recording sheet 1. The position in which the reference member 4 is held is determined by the shape and measurement of the cassette 2, which correspond to the width of the recording sheet 1 which is being conveyed. The sheet conveying apparatus 150 is structured so that the reference member 4 is moved into, and held in, the position in which it regulates the position of the recording sheet 1 so that after the recording sheet 1, which has obliquely reached the sheet conveying apparatus 150, is straightened, the path of the center of the recording sheets 1 through the sheet conveying apparatus 150 coincides with the paths of the centers of the other recording sheets 1 through the sheet conveying apparatus 150, in terms of the width direction of the recording sheet 1. In other words, as the cassette 2 is mounted into the recording apparatus, the reference member 4 is moved by the cassette 2. Therefore, even if the recording sheet 1 is obliquely fed, not only is the recording sheet 1 is straightened, but also, it is positioned so that the path of its center, in terms of its width direction, through the sheet conveying apparatus 150, coincides with those of the other recording sheets 1, regardless of the width of the recording sheets 1.

One of the positions indicated by a solid line in FIG. 9 is the position of the recording sheet 1*b* prior to the correction of its attitude, and the other is the position of the recording sheet 1*b* after the correction of its attitude. One of the positions indicated by a dotted line in FIG. 9 is the position of the recording sheet 1*a* prior to the correction of its attitude, and the other is the position of the recording sheet 1*a* after the correction of its attitude. As will be evident from the comparison between the positions indicated by the solid line and the positions indicated by the dotted line, the sheet conveying apparatus 150 in this embodiment does not align the lateral edges of two kinds of recording sheets against a reference surface. Rather, it aligns them so that the paths of their centers coincide. That is, the sheet conveying apparatus 150 in this embodiment is simple in structure, and yet, not only can it straighten in attitude the recording sheet 1, while being obliquely conveyed, but also, it can position all the recording sheets so that the paths of their center lines, in terms of their width direction, coincide, while the recording sheets 1 are conveyed through the sheet conveying apparatus 150. Moreover, the sheet conveying apparatus 150 in this embodiment is easier to assemble than a sheet conveying apparatus in accordance with the prior art, and its mechanism for straightening an obliquely conveyed recording sheet is more reliable, than that of a sheet conveying apparatus in accordance with the prior art.

Incidentally, in this embodiment, the reference member 4 is moved with the use of an electrical driving force source, such as an electric motor, an electrical plunger, or the like. The width of the recording sheet 1 is determined by identifying the type of the cassette 2 with the use of an electrical element (sensor). The sheet conveying apparatus 150 is structured so that as the recording sheets 1 are conveyed through the sheet conveying apparatus 150, not only are they straightened in attitude if they are oblique, but also, they are correctly positioned in terms of their width direction, by placing the reference member 4 in one of the abovementioned two positions. It should be specifically noted, however, that the sheet conveying apparatus 150 in this embodiment can be modified in structure so that the reference member 4 can be moved into three or more positions to enable the apparatus to correctly position three or more kinds (in terms of width) of recording sheets, in terms of their width direction, while correcting them in their attitude. More specifically, multiple cassettes which correspond in size and shape to the width of the recording sheets they store, are prepared, and the reference member 4 is moved by the pressing surface of the selected cassette, to the position which corresponds to the size of the recording sheets therein. In other words, the structural arrangement which makes a sheet conveying apparatus capable of straightening three or more kinds (in terms of width) of recording sheets is included in the scope of the present invention.

Figure 10:
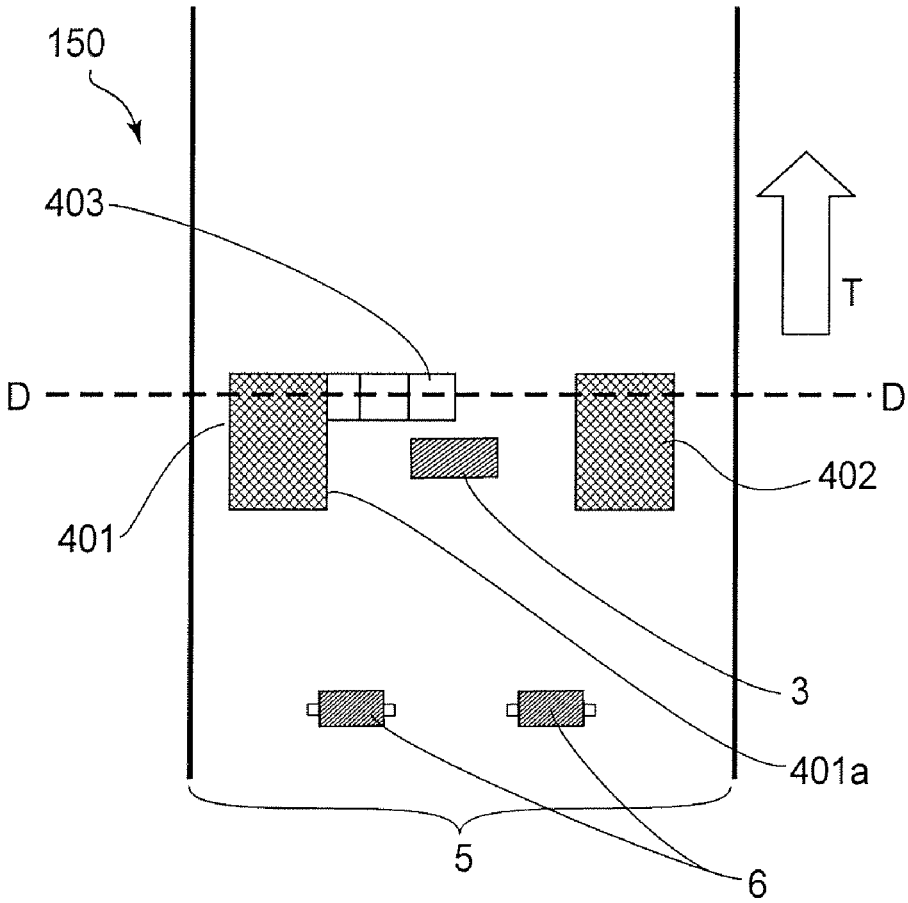
FIG. 10 is a substantial top plan view showing a state in which the cassette is not mounted in the sheet feeding apparatus according to the second embodiment of the present invention.
Figure 11:
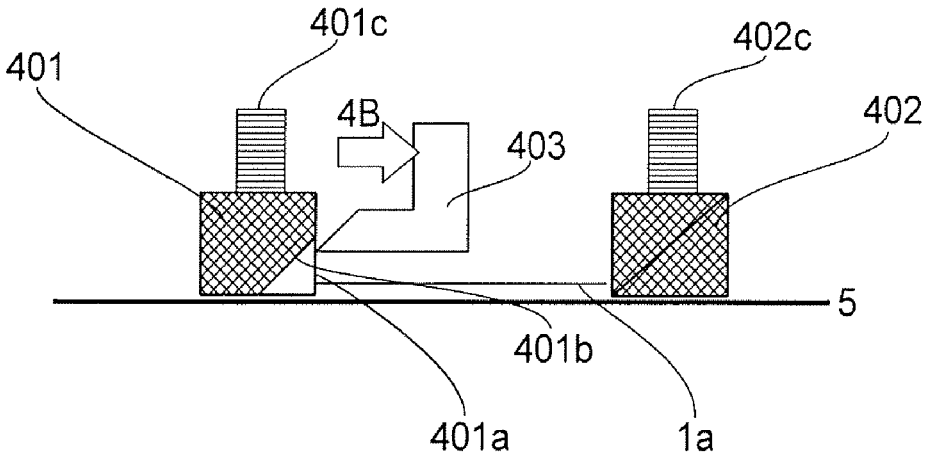
FIG. 11 is a sectional view taken along a line D-D in FIG. 10.
Figure 12:
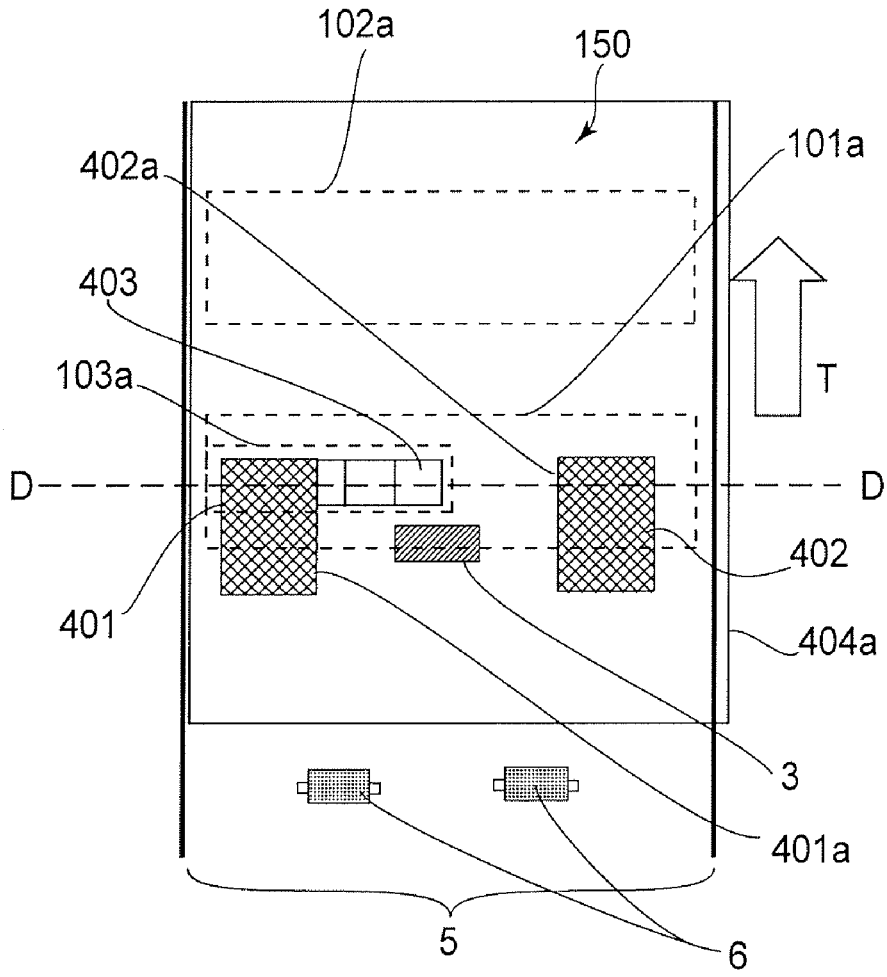
FIG. 12 is a schematic top plan view of the sheet feeding apparatus according to a second embodiment of the present invention, in which the inclination of the recording sheet having the first width is being corrected.
Figure 13:
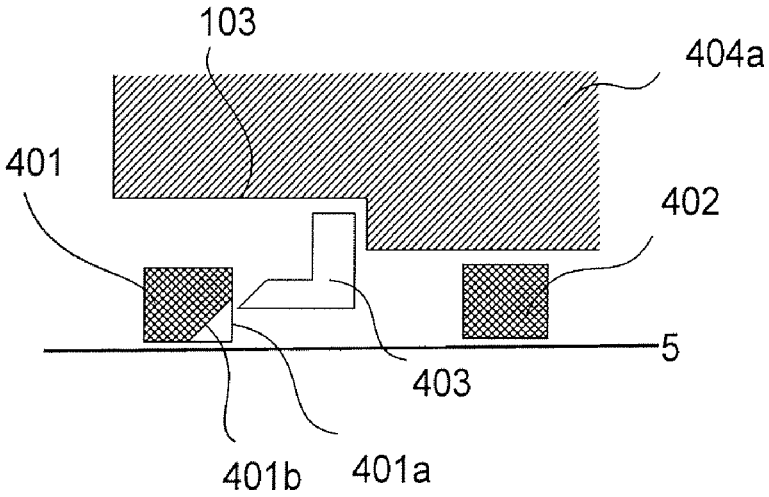
FIG. 13 is a sectional view taken along a line D-D in FIG. 12.
Figure 14:
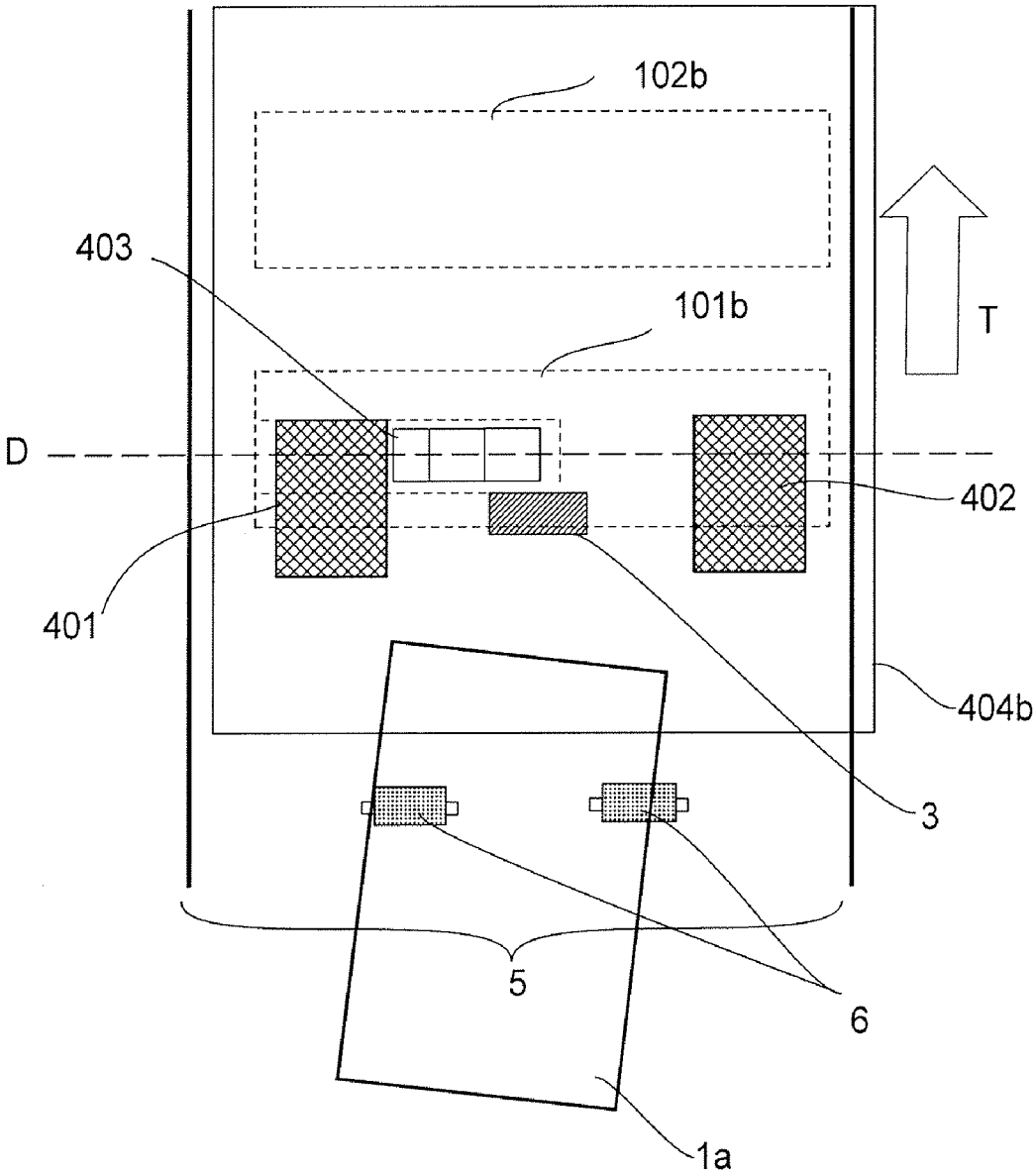
FIG. 14 is a schematic top plan view showing a state in which the recording sheet having the first is being corrected in the apparatus of the second embodiment.
Figure 15:
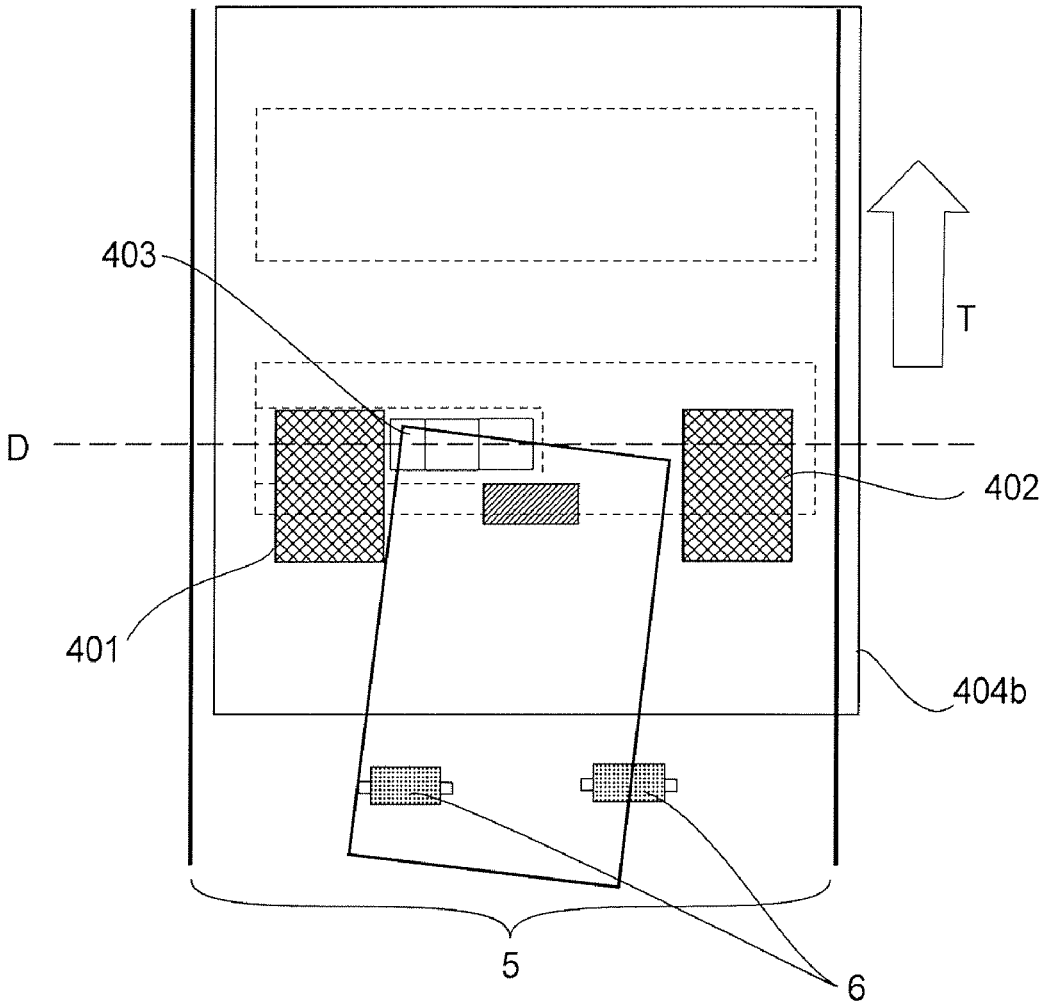
FIG. 15 is a schematic top plan view showing a state in which the recording sheet having the first is being corrected in the apparatus of the second embodiment.
Figure 16:
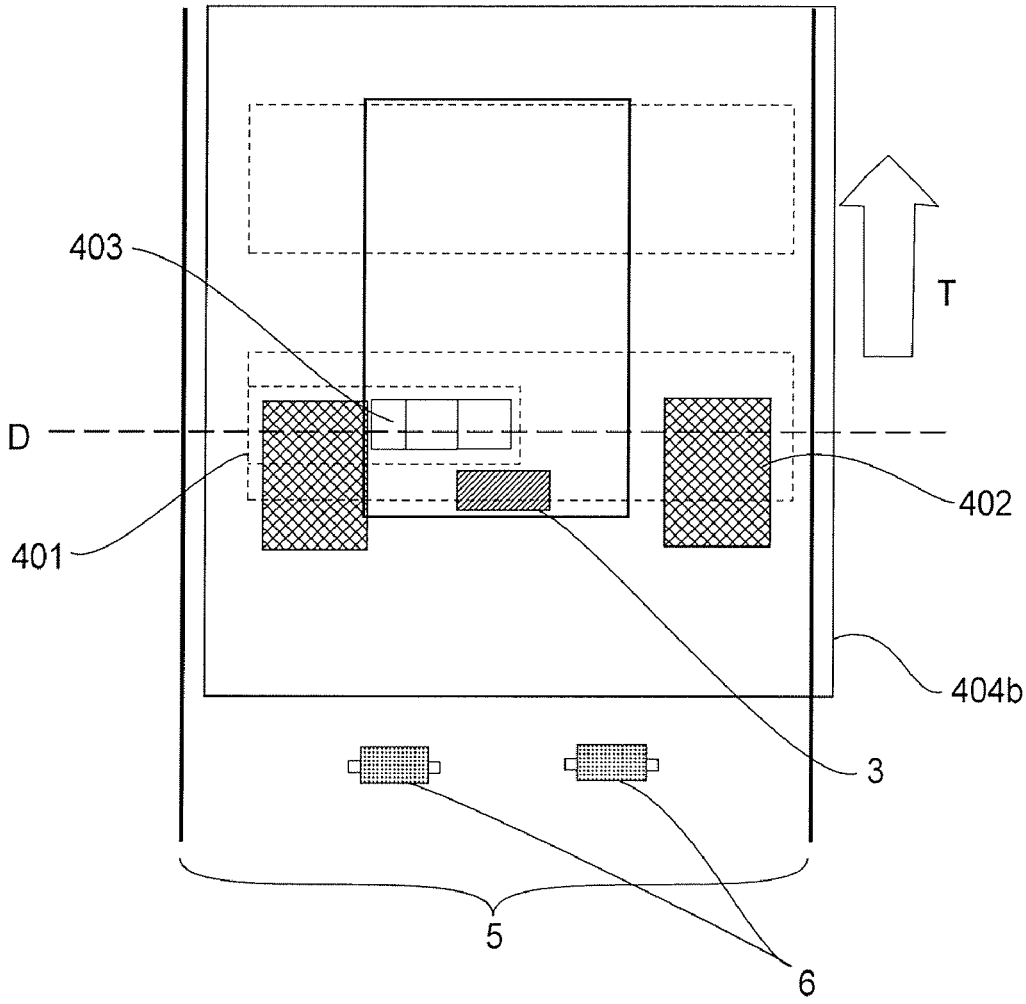
FIG. 16 is a schematic top plan view showing a state in which the recording sheet having the first is being corrected in the apparatus of the second embodiment.
Figure 17:
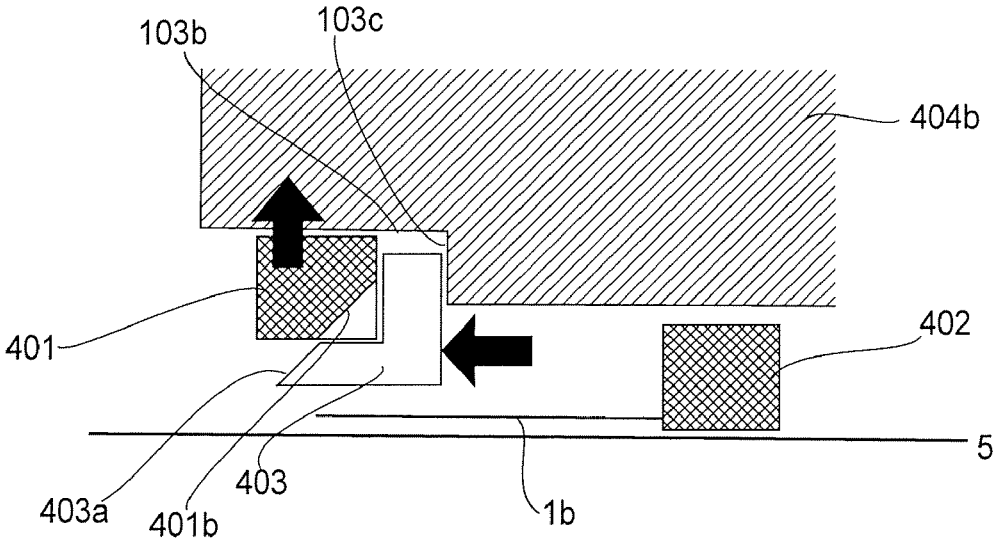
FIG. 17 is a schematic top plan view showing a state in which the inclination of the recording sheet having the second (large) width is being corrected in the sheet feeding apparatus according to the second embodiment the present invention.
Figure 18:
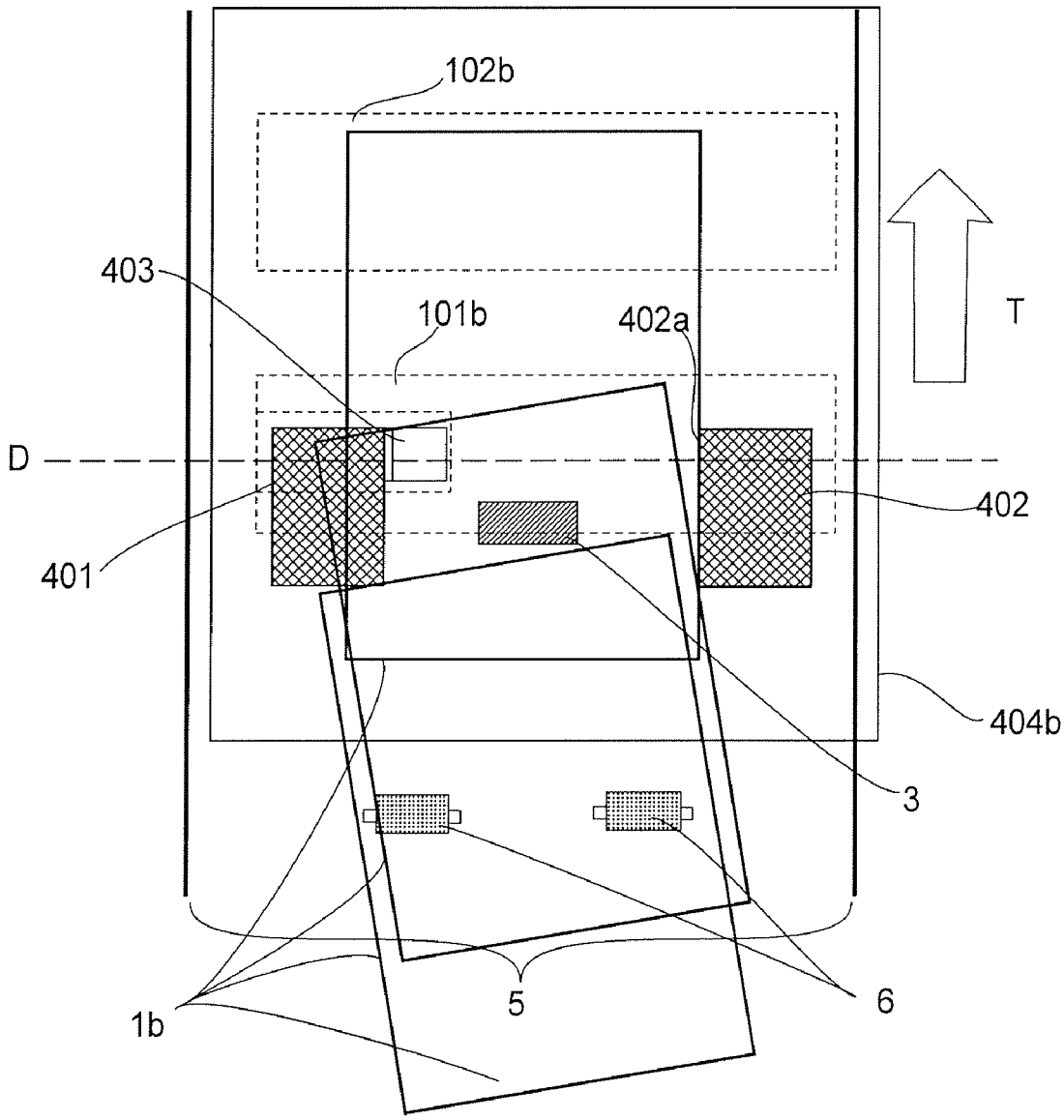
FIG. 18 is a sectional view taken along a line D-D in FIG. 14.
Figure 19:
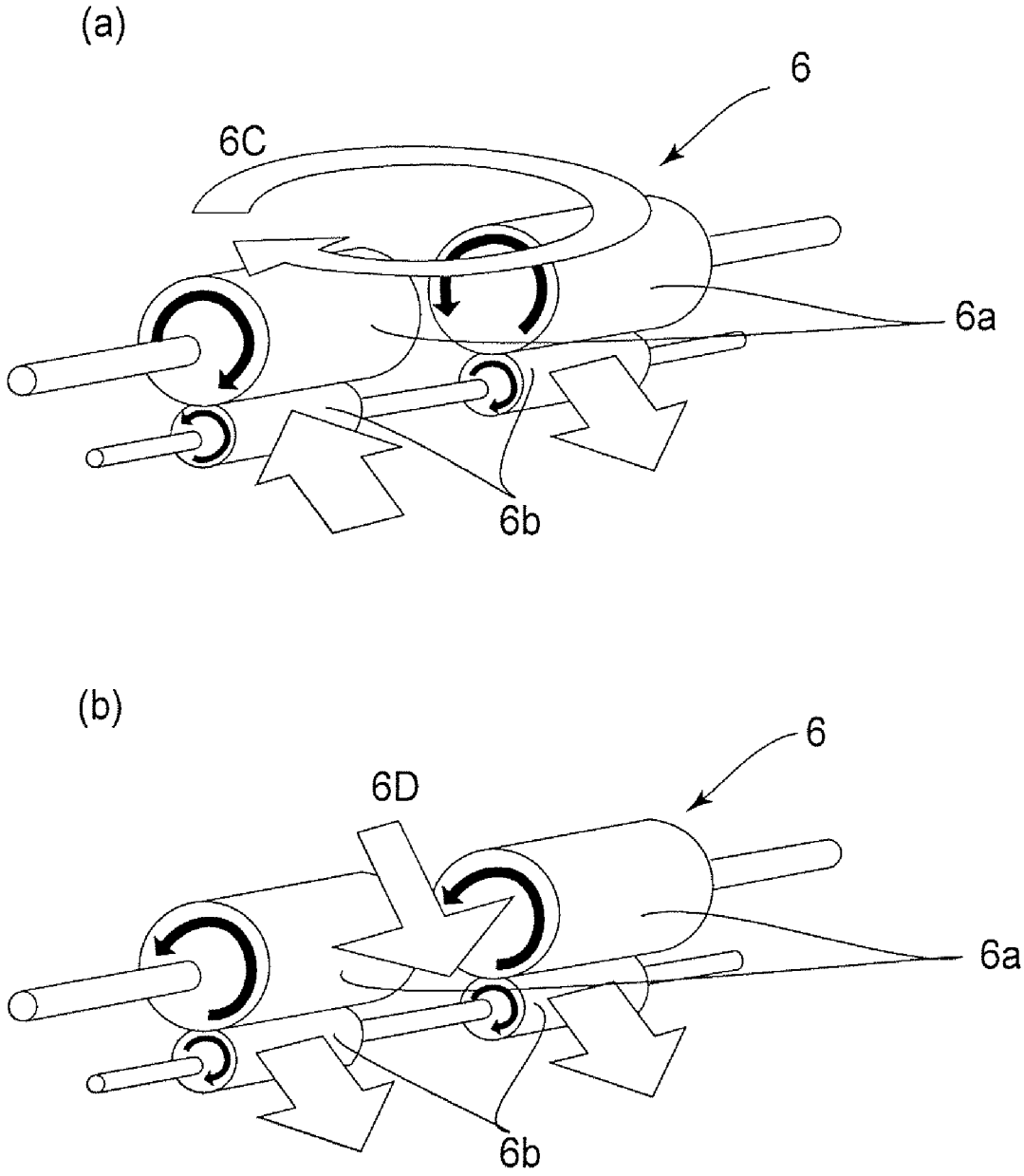
FIG. 19 is a schematic perspective view illustrating rotating means for rotating the recording sheet toward left and right, wherein (a) shows a state when the recording sheet is rotated, and (b) shows a state when the recording sheet is translated.
Figure 20:
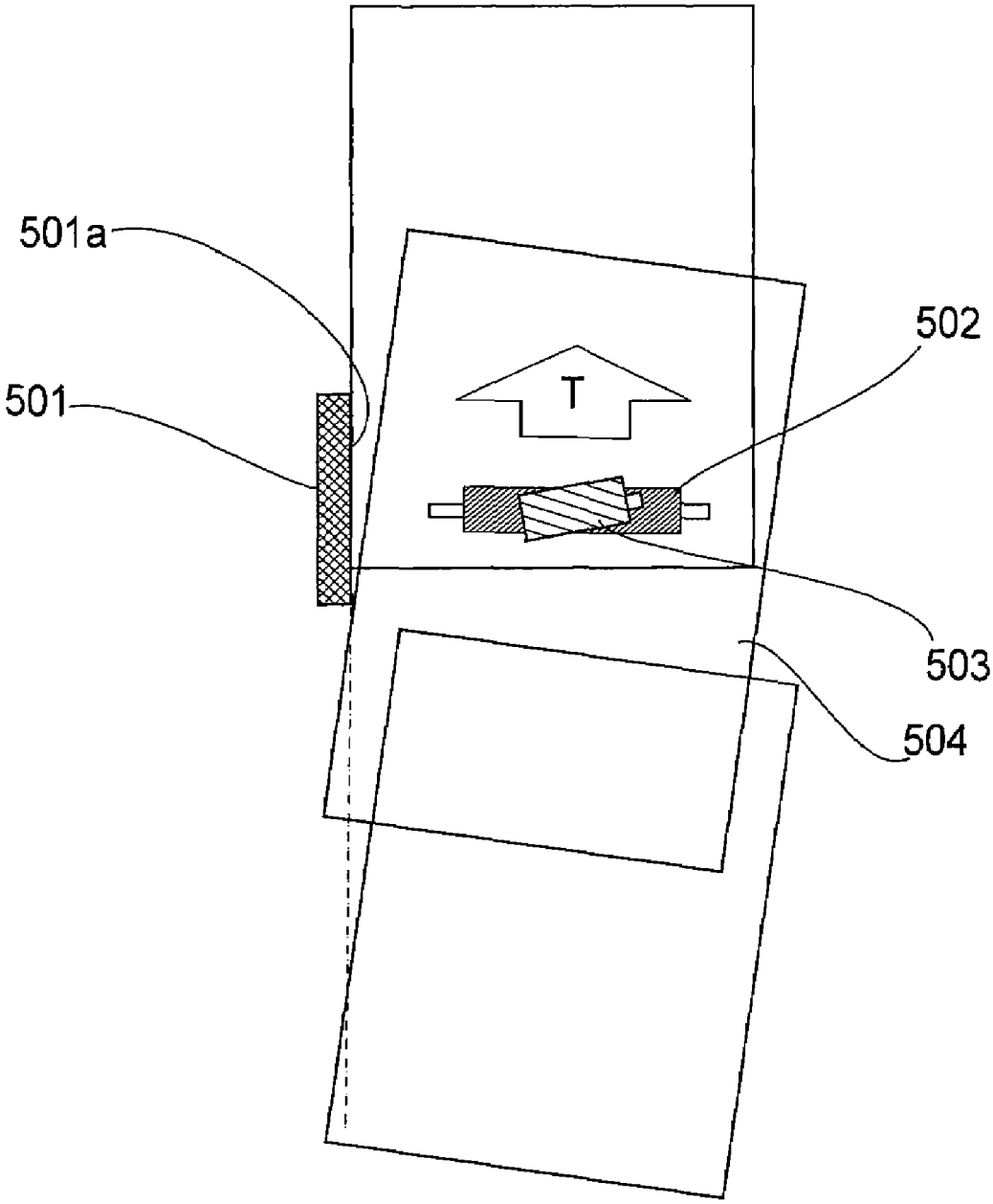
FIG.20 PRIOR ART
FIG. 20 is a schematic top plan view of a conventional inclination correcting mechanism.
Figure 21:
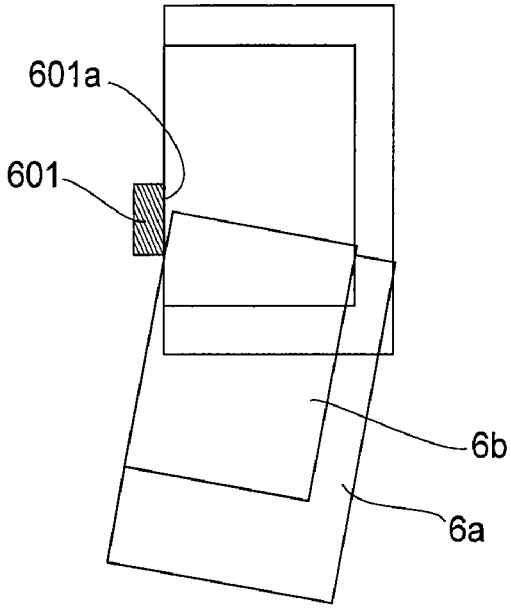
FIG.21 PRIOR ART
FIG. 21 is a schematic top plan view showing a state when the inclinations of the recording sheets having different widths are being corrected.
Figure 22:
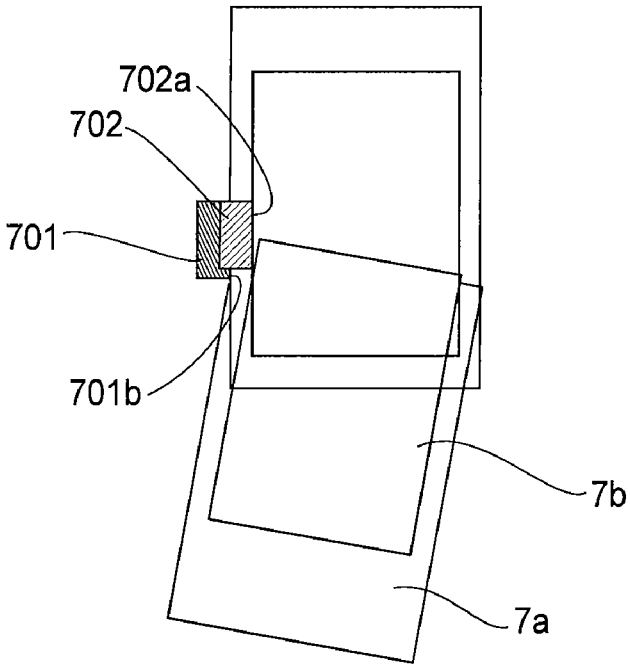
FIG.22 PRIOR ART
FIG. 22 is a schematic top plan view of a conventional inclination correcting mechanism capable of inclination correction with the center line alignment.

FIG. 10 is a schematic plan view of the sheet conveying apparatus, in the second embodiment of the present invention, in which the cassette 2 is not present. FIG. 11 is a sectional view of the sheet conveying apparatus shown in FIG. 10, at a line D-D in FIG. 10. FIG. 12 is a schematic plan view of the sheet conveying apparatus in the second embodiment of the present invention, in which an oblique recording sheet with the smaller width is being straightened. FIG. 13 is a sectional view, at a line D-D in FIG. 12, of the sheet conveying apparatus in the second embodiment of the present invention, which is in the state shown in FIG. 12. FIGS. 14, 15, and 16 are schematic plan views of the sheet conveying apparatus in the second embodiment of the present invention, which show how a recording sheet of the first width (smaller width) having obliquely reached the sheet conveying apparatus is straightened. FIG. 17 is a sectional view of the sheet conveying apparatus shown in FIG. 12, at the line D-D in FIG. 12. FIG. 18 is a schematic plan view of the sheet conveying apparatus in the second embodiment of the present invention, which shows how a recording sheet of the second width (which is larger than the first width) having obliquely reached the sheet conveying apparatus is straightened. FIG. 19 is a schematic perspective view of the means for rotating clockwise or counterclockwise a recording sheet having reached the sheet conveying apparatus, FIG. 19(*a*) showing the recording sheet being rotated, and FIG. 19(*b*) showing the recording sheet being moved in the direction parallel to the normal recording sheet conveyance direction. Hereafter, the sheet conveying apparatus in the second embodiment, which employs two reference members 401 and 402, will be described regarding its structural arrangement.

The sheet conveying apparatus in the second embodiment of the present invention, which is shown in FIGS. 10-18, is similar to the above described sheet conveying apparatus in the first embodiment, in that both sheet conveying apparatuses straighten an oblique recording sheet regardless of the width of the recording sheet. Also in the second embodiment, the sheet conveying apparatus is structured so that two kinds of cassettes in terms of the width of the recording sheet they store can be removably mounted. The second embodiment is different from the first embodiment in that the sheet conveying apparatus in the second embodiment is provided with multiple (two) reference members 401 and 402, a slider 403 as a means for moving one of the reference members, and a means capable of rotating a recording sheet clockwise or counterclockwise, and also, in that, unlike the conveyance roller 3 in the first embodiment, the conveyance roller 3 in the second embodiment is not slanted; it is perpendicularly positioned to the normal recording sheet conveyance direction so that when a recording sheet is conveyed, the lateral edges of the recording sheet remains parallel to the normal recording sheet conveyance direction.

Referring to FIGS. 10-18, the reference members 401 and 402 are located near the lateral edges of the sheet conveyance surface 5, one for one. The inwardly facing side of the reference member 401 (first reference member) is provided with a reference surface 401*a* for accurately positioning a recording sheet 1*a,* or the recording sheet with the first width, while straightening the recording sheet 1*a,* or the recording sheet with the first width, by regulating the position of one of the lateral edges of the recording sheet 1*a* after the recording sheet 1*a* is obliquely positioned. The inwardly facing side of the other reference member, or the reference member 402 (second reference member), is provided with a reference surface 402*a* for accurately positioning a recording sheet 1*b,* or the recording sheet with the second width which is greater than the first width, while straightening the recording sheet with the second width, by regulating the position of one of the lateral edges of the recording sheet 1*b* (including oblique recording sheet 1*b*) after the recording sheet 1*a* is obliquely positioned. These reference members 401 and 402 are kept under the pressure generated by a pair of compression springs 401*c* and 402*c,* one for one, in the direction to keep the reference members 401 and 402 in their bottom positions (in which reference members 401 and 402 are in contact with the sheet conveyance surface 5). The sheet conveyance roller 3 for conveying a recording sheet is disposed in contact with the sheet conveyance surface 5, and is located roughly at the mid point between the two reference surfaces. The sheet conveyance roller 3 is arranged perpendicular to the lateral edges of the sheet conveyance surface 5 to convey a recording sheet so that while the recording sheet is conveyed by the sheet conveyance roller 3, the lateral edges of the recording sheet remain parallel to the normal recording sheet conveyance direction. Further, the sheet conveying apparatus is provided with a recording sheet rotating means (attitude controlling means) made of two pairs 6 of recording sheet rotating rollers. The recording sheet rotating means is on the upstream side of the reference members 401 and 402 on the sheet conveyance surface 5, in terms of the recording sheet conveyance direction.

The reference member 401, which is for a recording sheet with the smaller width, is also provided with a slanted surface 401*b,* which also faces inward like the reference surface 401*a* and is located so that it does not interferes with the function of the reference surface 401*a.* The aforementioned slider 403 (movable means), which is for lifting the reference member 401 against the force generated by the resiliency of the spring 401*c,* is located in the inward adjacencies of the abovementioned slanted surface 401*b.* The slider 403 is kept pressured by the elastic force 4B (springy force) in the direction to move away from the slanted surface 401*b.* As a cassette 404*b* which contains the recording sheets 1*b,* or the sheets with the greater width, is mounted, the slider 403 is moved by this cassette 404*b* toward the slanted surface 401*b* against the force 4B, as will be described later. As the slider 403 is changed in position as described above, the reference member 401 is lifted into its retreat (FIG. 15) against the force 4A generated by the spring 401*c.* On the other hand, as the cassette 404*b* is removed, the slider 403 and reference member 401 are moved back into their home positions (initial positions), shown in FIG. 11, by the force 4B, and the force 4A generated by the spring 401*c,* respectively. However, when a cassette 404*a,* which stores the recording sheets of the smaller width, is mounted, the slider 403 and reference member 401 remain in their home positions (initial positions).

At this time, referring to FIG. 19, the structure and operation of the recording sheet rotating means made up of the two pairs 6 of recording sheet rotating rollers will be described. The two pairs 6 of recording sheet rotating rollers are aligned in the direction perpendicular to the normal recording sheet conveyance direction, with the provision of a preset distance between the two pairs 6. Each of the pair 6 of recording sheet rotating rollers (which correspond to pair of rollers 6 and 6 in FIG. 10) is made up of a driving roller 6*a* and following roller 6*b.* A recording sheet is conveyed through both of the nips between the two pairs 6 of recording sheet rotating rollers (6*a* and 6*b*). Referring to FIG. 19(*a*), as the driving roller 6*a* of one of the two pairs 6 of recording sheet rotating rollers is rotated in the direction opposite to the direction in which the driving roller 6*a* of the other pair 6 is rotated, as shown by two arrow marks, the recording sheet is subjected to the torque generated by the friction between the recording sheet and one of the pairs 6 of sheet rotating rollers and the friction between the recording sheet and the other pair 6. Thus, the recording sheet is rotated by this torque about an axis perpendicular to the surface of the recording sheet, in the direction indicated by an arrow mark 6*c.* Incidentally, the recording sheet can be rotated in the direction opposite to the direction indicated by the arrow mark 6*c,* by rotating the two driving rollers 6*a* and 6*a* in the directions opposite to the abovementioned directions indicated by the two arrow marks. On the other hand, as the two driving rollers 6*a* and 6*a* are rotationally driven in the same direction as shown in FIG. 19(*b*), the recording sheet is subjected to two parallel forces which are generated by the two pairs 6 of recording sheet rotating rollers, one for one. Thus, the recording sheet is conveyed in the direction indicated by an arrow mark 6D, which is parallel to the normal recording sheet conveyance direction T.

Next, referring to FIGS. 10-19, the relationship between the width of the recording sheet 1, which is being conveyed, and the operation of the sheet conveying apparatus 150, will be described. FIGS. 12 and 13, which correspond to FIGS. 10 and 11, respectively, show the state of the sheet conveying apparatus 150 after the mounting of the cassette 404*a* containing the recording sheets 1*a,* or the recording sheet with the first width (smaller width), into the recording apparatus 100. FIG. 17, which corresponds to FIGS. 10 and 11, shows the state of the sheet conveying apparatus 150 after the mounting of the cassette 404*b* containing the recording sheet 1*b,* or the recording sheet with the second width, which is greater than the first width, into the recording apparatus 100.

The reference surfaces 401*a* and 402*a* of the reference members 401 and 402, respectively, are parallel to the normal recording sheet conveyance direction T, and are perpendicular to the sheet conveying surface 5. An oblique recording sheet 1*a,* or an oblique recording sheet with the first width, straightens while it is conveyed through the sheet conveying apparatus, with one of its lateral edges (left edge in drawing) placed in contact with the reference surface 401*a.* On the other hand, an oblique recording sheet 1*b,* or an oblique recording sheet with the second width, straightens while it is conveyed through the sheet conveying apparatus, with one of its lateral edges (right edge in drawing) placed in contact with the reference surface 402*a.* The reference surfaces 401*a* and 402*a* are positioned so that once the oblique recording sheet with the smaller width and the oblique recording sheet with the greater width are straightened, their centers in terms of their width direction coincide (so that they will be centered relative to sheet conveyance surface 5 in terms of their width direction).

FIGS. 12 and 13 show the state of the sheet conveying apparatus 150 after the mounting of the cassette 404*a,* or the cassette containing the recording sheets 1*a,* or the recording sheets with first width (smaller width), into the main assembly of the recording apparatus 100. Referring to FIG. 12, the two areas contoured by broken lines 101*a* and 102*a* are where the ink ribbon chambers, from which the ink ribbon is wound out, and the ink ribbon chamber, into which the ink ribbon is wound up, are located below the cassette 404*a*. The ink ribbon chamber 101*a,* from which the ink ribbon is wound out, is provided with a recess 103*a* for preventing the interference (contact) between the ink ribbon chamber 101*a* and slider 403. Referring to FIG. 13, when the cassette 404*a,* which is for the recording sheet of the smaller width, is mounted into, or in, the main assembly of the recording apparatus 100, it does not contacts the slider 403; it does not press the slider 403. Therefore, even when the cassette 404*a* is in the main assembly, the reference member 401 remains held in the home position (contact position) in which it allows the recording sheet 1*a* to come into contact therewith.

Referring to FIG. 14, as the recording sheet 1*a* fed from the cassette 404*a* into the apparatus main assembly is conveyed to the sheet conveying apparatus 150, the sheet conveying apparatus 150 rotates the recording sheet 1*a* by the pairs 6 of sheet rotating rollers as sheet rotating means, on the upstream side of the reference members 401 and 402 in terms of the recording sheet conveyance direction, so that the recording sheet 1*a* slants rightward in the drawing. After rotating (slanting) the recording sheet 1*a* so that the trailing portion of the recording sheet 1*a,* that is, the upstream portion of the recording sheet 1*a,* in terms of the normal recording sheet conveyance direction T, is deviated toward the lateral edge of the sheet conveyance surface 5 on the reference surface 401*a* side, relative to the leading portion, or the downstream portion, of the recording sheet 1*a,* the sheet conveying apparatus 150 moves the recording sheet 1*a* in the direction parallel to the normal recording sheet conveyance direction T by the two pairs 6 of sheet rotating rollers. As a result, the left lateral edge of the recording sheet 1*a* is placed in contact with the reference surface 401*a* of the reference member 401, as shown in FIG. 15. Thus, as the slanted recording sheet 1*a* is conveyed by the sheet conveyance roller 3, it is straightened by the reference surface 401*a*. More specifically, the recording sheet 1*a* is slanted so that its trailing portion is deviated toward the lateral edge of the sheet conveyance path 5 on the reference surface 401*a* side. Thus, as the recording sheet 1*a* is conveyed through the sheet conveying apparatus 150, the upstream end portion of the left lateral edge of the recording sheet 1*a* come into contact with the reference surface 401*a,* and then, is further conveyed in the direction parallel to the normal recording sheet conveyance direction T while being gradually straightened. In this case, the recording sheet 1*a* is straightened while it is conveyed between the left and right reference members 401 and 402. Therefore, it does not occur that the right reference member 402 interferes with the straightening of the recording sheet 1*a* (FIG. 16). Further, at the same time as the slanted recording sheet 1*a* is straightened, it is correctly positioned (centered) by the reference surface 401*a* relative to the image forming portion in terms of the direction perpendicular to the normal direction in which the recording sheet 1*a,* or the recording sheet with the smaller width, is conveyed.

FIGS. 17 and 18 show the state of the sheet conveying apparatus 150 after the mounting of the cassette 404*b,* or the cassette containing the recording sheets 1*b,* or the recording sheets with second width, into the main assembly of the recording apparatus 100. Referring to FIG. 18, the two areas contoured by broken lines 101*b* and 102*b* are where the ink ribbon chamber, from which the ink ribbon is unwound, and the ink ribbon chamber, into which the ink ribbon is wound up are located, respectively, below the cassette 404*b*. The ink ribbon chamber 101*b,* from which the ink ribbon is unwound, is provided with a recess 103*b,* which is provided with a pressing surface 103*c* for moving the slider 403 leftward as the cassette 404*b* is inserted into the main assembly of the recording apparatus 100. More specifically, as the cassette 404*b* containing the recording sheets 1*b,* or the recording sheets with the larger width, is inserted into the recording apparatus main assembly, the slider 403 is pressed by the pressing surface 103*c,* being thereby moved leftward against the force 4B generated by the spring. As the slider 403 is moved leftward, the surface 403*a* of the slider 403 comes into contact with the slanted surface 401*b* of the reference member 401, and lifts the reference member 401 while remaining in contact with the reference member 401. By the time the cassette 404*b* is set in its operational position in the recording apparatus main assembly, the reference member 401 is lifted into the retreat position, shown in FIG. 17, in which the reference member 401 does not regulate the position of the lateral edge of the recording sheet 1*b*. As a result, a gap which is large enough for the recording sheet 1*b* to freely pass is created below the reference member 401. In other words, the reference member 401 remains held in the position in which it does not interfere even if an oblique recording sheet 1*b,* or an oblique recording sheet with the second width (larger width), is conveyed while being straightened, through the sheet conveying apparatus.

As the recording sheet 1*b* is fed from the cassette 404*a* into the apparatus main assembly and is conveyed to the sheet conveying apparatus 150, which is in the state shown in FIGS. 17 and 18, the sheet conveying apparatus 150 rotates the recording sheet 1*b* by the pairs 6 of sheet rotating rollers, on the upstream side of the reference members 401 and 402, in terms of the recording sheet conveyance direction, so that the recording sheet 1*b* slants leftward in the drawing. After rotating (slanting) the recording sheet 1*b* so that the downstream portion of the recording sheet 1*b,* in terms of the normal recording sheet conveyance direction T, is moved away from the reference surface 402*a,* the sheet conveying apparatus 150 moves the recording sheet 1*b* in the direction parallel to the normal recording sheet conveyance direction T by the pairs 6 of sheet rotating rollers. As a result, the right lateral edge of the recording sheet 1*b* is placed in contact with the reference surface 402*a* of the reference member 402. Then, the obliquely positioned recording sheet 1*b* is straightened by the reference surface 402*a* while being conveyed by the recording sheet conveyance roller 3, remaining in contact with the reference surface 402*a,* in the direction parallel to the normal recording sheet conveyance direction T. Since the recording sheet 1*b* is obliquely positioned so that its trailing portion is deviated toward the lateral edge of the sheet conveyance surface 5 on the reference surface 402*a* side, the recording sheet 1*b* is conveyed, with the upstream portion of the recording sheet 1*b* remaining in contact with the reference surface 402*a*. Therefore, it is conveyed in the direction parallel to the normal recording sheet conveyance direction T, while being subjected to the pressure generated in the direction to straighten the recording sheet 1*b*. In this case, the recording sheet 1*b* is straightened while it is conveyed below the reference member 401 which is in the retreat position. Therefore, it does not occur that the reference member 401 interferes with the straightening of the recording sheet 1*b* (FIG. 16). Further, at the same time as the obliquely positioned recording sheet 1*b* is straightened, it is correctly positioned by the reference surface 402*a* relative to the image forming portion 123, in terms of the direction perpendicular to the normal direction T in which the recording sheet 1*b* is conveyed.

Incidentally, as the cassette 404*b*, or the cassette for the recording sheet of the larger width, is removed, the slider 403 is returned to the home position (initial position), and the reference member 401 is returned by the spring 401*c* to the position in which the reference member 401 remains in contact with the sheet conveyance surface 5. That is, the reference surface 401*a* is returned to the position, shown in FIGS. 11 and 13, in which it comes into contact with a recording sheet 1*a*.

With the employment of the sheet conveying apparatus which is structured and operates as described above, it does not occur that the reference member 401, or the reference member for the recording sheet with the smaller width, interferes when conveying the obliquely positioned recording sheet with the larger width while straightening it, and therefore, not only is it possible to straighten an obliquely positioned recording sheet, but also, correctly position the recording sheet, in terms of the width direction of the recording sheet, regardless of recording sheet width. The positions of the left and right reference members 401 and 402, respectively, are selected so that, in terms of the width direction of the recording sheet, the path of the center of the recording sheet 1*a* which moves along the reference surface 401*a* coincides with the path of the center of the recording sheet 1*b*, which is different in width from the recording sheet 1*a* and moves along the reference surface 402*a*. Therefore, not only can the two kinds of recording sheets in terms of width be straightened (if they are obliquely positioned), by these reference members, but also, they can be positioned so that their centers in terms of the width direction coincide.

The second embodiment of the present invention described above with reference to FIGS. 10-19 also makes it possible to provide a sheet conveying apparatus having a mechanism for straightening an oblique recording sheet, which is simple in structure, is capable of conveying multiple kinds of recording sheets in terms of width, while straightening (if they are obliquely positioned) and positioning the recording sheets so that the paths of the centers of the recording sheets coincide, is easy to assemble, and is highly reliable. Further, in the second embodiment, the sheet conveying apparatus is structured so that the positions of the reference members 201 and 202 are automatically and mechanically set by the cassette 404, the shape and size of which corresponds to the width of the recording sheet 1. Therefore, the second embodiment is superior in terms of mechanical simplicity and ease of assembly to the above described first embodiment, in which the sheet conveying apparatus was structured so that the recording sheet width is identified with the use of a sensor or the like, and the reference member 4 was moved with the use of an electrical driving power source. Moreover, the second embodiment is superior to the first embodiment in terms of reliability.

Incidentally, in the second embodiment described above, the sheet conveying apparatus was structured so that the two kinds of recording sheets in terms of width were correctly positioned in terms of the width direction of the recording sheets, while being straightened (if they were obliquely positioned), by two reference members, one of which is movable to a retreat position. Incidentally, this embodiment can be modified to employ three of more reference members so that the reference members other than the reference member for the recording sheet of the largest width can be moved to their retreats. With such a modification, the sheet conveying apparatus can be structured so that three or more kinds of recording sheets in terms of width can be straightened (if they are obliquely positioned) and correctly positioned in terms of their width direction (for example, they can be positioned so that the paths of their centers coincide). In other words, the present invention includes in its scope the structural arrangement capable of straightening three or more kinds of recording sheets in terms of width (if they are obliquely positioned).

In the preceding embodiments of the present invention, the present invention was described with reference to only the recording apparatus of the thermal transfer type, which employed the sheet conveying apparatus. However, the present invention is also applicable to other recording apparatuses than the recording apparatus of the thermal transfer type, for example, an ink jet recording apparatus, a laser beam recording apparatus, a thermal recording apparatus, a wire-dot recording apparatus, etc., which employ the sheet conveying apparatus. Further, the present invention is applicable to various recording apparatuses which employ the sheet conveying apparatus, regardless of the number of recording heads, the positioning of recording heads, and the structure of recording heads.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 032448/2006 filed Feb. 9, 2006 which is hereby incorporated by reference.

What is claimed is:

1. A sheet feeding apparatus to which a cassette accommodating a sheet is detachably mountable, said sheet feeding device comprising:

supplying means for supplying the sheet from said cassette;

a reference member having a reference surface for regulating a position of a lateral edge of the sheet being fed in a predetermined feeding direction by said supplying means;

feeding means for feeding the sheet such that lateral edge of the sheet abuts the reference surface;

moving means for selectively moving said reference member in response to mounting of said cassette; and orientation control means for controlling an orientation of the sheet to abut the lateral edge of the sheet to said reference member, before said feeding means feeds the sheet while contacting it to the reference surface;

wherein said reference member comprises a first reference member for regulating a position of a lateral edge of a sheet having a first width, and a second reference member for regulating a position of a lateral edge of a sheet having a second width which is larger than the first width, wherein said moving means moves the first reference member to a position not regulating the lateral edge of the sheet when a cassette accommodating the sheet having the second width is mounted, wherein the first reference member and the second reference member regulate the lateral edges at opposite sides, and wherein in the case that the sheet having the first width is fed, said orientation control means controls the orientation of the sheet so as to incline the sheet to make a trailing end of the sheet closer to the first regulating member than a leading end of the sheet, and in the case that the sheet having the second width is fed, said orientation control means controls the orientation of the sheet so as to incline the sheet to make a trailing end of the sheet closer to the second regulating member than a leading end of the sheet.

2. An apparatus according to claim 1, wherein said orientation control means controls an orientation of the sheet so as to incline the sheet to make a trailing end of the sheet closer to the reference member than a leading end of the sheet, thus abutting the lateral edge of the sheet to said reference member, before said feeding means feeds the sheet.

3. An apparatus according to claim 2, wherein the orientation of the sheet changes such that lateral edge thereof moves along the reference surface of said reference member by the sheet being fed in the feeding direction by said feeding means in a state in which the lateral edge is contacted to said reference member.

4. An apparatus according to claim 2, wherein said orientation control means controls an orientation of the sheet by rotating the sheet about an axis extending in a direction of thickness of the sheet.

5. An apparatus according to claim 4, wherein said orientation control means includes two rollers which are contactable to the same surface of the sheet and which are rotatable in opposite directions.

6. An apparatus according to claim 1, wherein the orientation of the sheet changes such that lateral edge thereof moves along the reference surface of said first or second reference member by the sheet being fed in the feeding direction by said feeding means in a state in which the lateral edge is contacted to said first or second reference member.

7. An apparatus according to claim 1, wherein said orientation control means controls an orientation of the sheet by rotating the sheet about an axis extending in a direction of thickness of the sheet.

8. An apparatus according to claim 7, wherein a center line, with respect to the widthwise direction, of the sheet guided by said reference surface of said first or second reference member passes a predetermined position irrespective of the width of the sheet.

9. An apparatus according to claim 1, wherein said moving means includes a cam member for moving said reference member by being pushed by said cassette when said cassette is mounted to said apparatus.

10. A recording apparatus to which a cassette accommodating a sheet is detachably mountable, said recording apparatus comprising:

supplying means for supplying the sheet from said cassette;

a reference member having a reference surface for regulating a position of a lateral edge of the sheet being fed in a predetermined feeding direction by said supplying means;

feeding means for feeding the sheet such that lateral edge of the sheet abuts the reference surface;

moving means for selectively moving said reference member in response to mounting of said cassette;

an image forming station for forming an image on the sheet fed by said feeding means; and orientation control means for controlling an orientation of the sheet to abut the lateral edge of the sheet to said reference member, before said feeding means feeds the sheet while contacting it to the reference surface;

wherein said reference member comprises a first reference member for regulating a position of a lateral edge of a sheet having a first width, and a second reference member for regulating a position of a lateral edge of a sheet having a second width which is larger than the first width, wherein said moving means moves the first reference member to a position not regulating the lateral edge of the sheet when a cassette accommodating the sheet having the second width is mounted, wherein the first reference member and the second reference member regulate the lateral edges at opposite sides, and wherein in the case that the sheet having the first width is fed, said orientation control means controls the orientation of the sheet so as to incline the sheet to make a trailing end of the sheet closer to the first regulating member than a leading end of the sheet, and in the case that the sheet having the second width is fed, said orientation control means controls the orientation of the sheet so as to incline the sheet to make a trailing end of the sheet closer to the second regulating member than a leading end of the sheet.

* * * * *